US011551600B2

(12) United States Patent
Cheng et al.

(10) Patent No.: US 11,551,600 B2
(45) Date of Patent: Jan. 10, 2023

(54) DISPLAY PANEL AND DISPLAY DRIVING CIRCUIT FOR DRIVING DISPLAY PANEL

(71) Applicant: Novatek Microelectronics Corp., Hsinchu (TW)

(72) Inventors: Yen-Cheng Cheng, Hsinchu (TW); Hsiu-Hui Yang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/149,693

(22) Filed: Jan. 14, 2021

(65) Prior Publication Data

US 2021/0225248 A1 Jul. 22, 2021

Related U.S. Application Data

(60) Provisional application No. 62/961,713, filed on Jan. 16, 2020.

(51) Int. Cl.
*G09G 3/20* (2006.01)

(52) U.S. Cl.
CPC ..... *G09G 3/2007* (2013.01); *G09G 2310/027* (2013.01); *G09G 2310/0251* (2013.01); *G09G 2310/0254* (2013.01); *G09G 2330/023* (2013.01)

(58) Field of Classification Search
CPC ... G09G 2310/0251; G09G 2310/0254; G09G 2310/027; G09G 2330/023; G09G 3/2007; G09G 2330/12; G09G 3/20
See application file for complete search history.

(56) References Cited

U.S. PATENT DOCUMENTS

| | | | | |
|---|---|---|---|---|
| 6,980,186 | B2 | 12/2005 | Nakano et al. | |
| 8,427,461 | B2 | 4/2013 | Lin | |
| 8,552,950 | B2 | 10/2013 | Hirakata | |
| 2003/0107543 | A1* | 6/2003 | Nakano | G09G 3/3607 345/90 |
| 2010/0164913 | A1 | 7/2010 | Lin | |
| 2015/0379947 | A1 | 12/2015 | Sang et al. | |
| 2016/0078836 | A1* | 3/2016 | Kim | G09G 3/3614 345/209 |

(Continued)

FOREIGN PATENT DOCUMENTS

| | | | |
|---|---|---|---|
| CN | 106710538 | 5/2017 | |
| JP | 5629439 B2 * | 11/2014 | G09G 3/3688 |

(Continued)

OTHER PUBLICATIONS

"Office Action of Taiwan Counterpart Application", dated Sep. 8, 2021, p. 1-p. 5.

*Primary Examiner* — Kenneth Bukowski
(74) *Attorney, Agent, or Firm* — JCIPRNET

(57) ABSTRACT

A display panel is provided. The display panel includes a pixel array, multiple data lines and first scan lines. The pixel array is arranged in multiple pixel rows by multiple pixel columns, and includes a first pixel row, a second pixel row, and a third pixel row which are adjacent pixel rows. The first scan line is coupled to multiple first pixel groups. Each first pixel group includes multiple first pixels in the first pixel row and multiple second pixels in the second pixel row adjacent to the first pixel row. A display driving circuit for driving a display panel is also provided.

13 Claims, 20 Drawing Sheets

300

(56) References Cited

U.S. PATENT DOCUMENTS

| | | | | |
|---|---|---|---|---|
| 2017/0287420 | A1* | 10/2017 | Noguchi | G09G 3/3688 |
| 2018/0315384 | A1* | 11/2018 | Ikeda | G09G 3/3614 |
| 2019/0340988 | A1* | 11/2019 | Yan | G09G 3/3688 |
| 2020/0105219 | A1 | 4/2020 | Fujikawa | |

FOREIGN PATENT DOCUMENTS

| | | |
|---|---|---|
| TW | 583630 | 4/2004 |
| TW | 201025266 | 7/2010 |

* cited by examiner

DISPLAY PANEL AND DISPLAY DRIVING CIRCUIT FOR DRIVING DISPLAY PANEL

CROSS-REFERENCE TO RELATED APPLICATION

This application claims the priority benefit of U.S. provisional application Ser. No. 62/961,713, filed on Jan. 16, 2020. The entirety of the above-mentioned patent application is hereby incorporated by reference herein and made a part of this specification.

BACKGROUND

Technical Field

The disclosure relates to a display panel, and particularly a display panel capable of executing a charge recovery mechanism.

Description of Related Art

Through enabling the display panel to display a test pattern with alternating black and white horizontal stripes (hereinafter referred to as "H line"), the power consumption of the display panel may be measured. FIG. 1 is a schematic diagram of the display panel displaying "H line". In FIG. 1, a display panel 100 includes multiple data lines (such as DL1 to DL6), multiple scan lines (such as SL0 to SL3), and a pixel array composed of multiple pixel columns (such as C1 to C6) and multiple pixel rows (such as R1 to R4). In FIG. 1, "+" and "−" respectively represent a positive-polarity data voltage and a negative-polarity data voltage, and the numbers (such as 0 and 255) represent the grayscale value of pixels. Please refer to FIG. 1. In terms of 8-bit data resolution, as the scan line period advances, the data voltages output by the source driver (not shown) of the display panel 100 via the multiple data lines DL1 to DL6 transit between the highest data voltage corresponding to the grayscale value 255 and the lowest data voltage corresponding to the grayscale value 0. In this way, the display screen may show a pattern with alternating black and white horizontal stripes. Therefore, the display panel 100 is in a high-power consumption state when displaying "H line". In addition, the larger the size of the display panel 100, the longer the length of the data line. Under such situation, the large parasitic capacitance of the data line will also increase the power consumption of the display panel 100.

Generally speaking, the charge recovery mechanism is usually adopted to reduce the power consumption of the display panel. In detail, after the current scan line period, through short-circuiting (for a period of time) together multiple data lines with the same output polarity and large grayscale value difference, an initial data voltage or said a beginning data voltage on the data lines for the next scan line period is obtained and equivalent to an intermediate grayscale value. In this way, the source driver may enable the data lines which are short-circuited (after charging/discharging to the date lines in the current scan line period have been completed) to be charged from the initial data voltage corresponding to the intermediate grayscale value during the next scan line period, rather than being charged from the current data voltage during the current scan line period, so as to achieve the objective of power saving through the charge recovery mechanism. However, in view of the coupling relationship shown in FIG. 1, since the grayscale values corresponding to the data voltages output by the source driver of the display panel 100 during the same scan line period are all the same (either 255 or 0), the architecture of the display panel 100 shown in FIG. 1 executes the charge recovery mechanism when displaying "H line" and ends up with no effect.

Therefore, it is necessary to provide a technical solution to reduce the power consumption of the display panel.

SUMMARY

The disclosure provides a display panel and a display driving circuit for driving the display panel to reduce the power consumption of the display panel through executing a charge recovery mechanism.

The disclosure provides a display panel. The display panel includes a pixel array, multiple data lines, and first scan lines. The pixel array is arranged in multiple pixel rows by multiple pixel columns, and includes a first pixel row, a second pixel row, and a third pixel row which are adjacent pixel rows. The first scan line is coupled to multiple first pixel groups. Each first pixel group includes multiple first pixels in the first pixel row and multiple second pixels in the second pixel row adjacent to the first pixel row.

The disclosure provides a display driving circuit for driving a display panel. The display panel includes a pixel array arranged in multiple pixel rows by multiple pixel columns, multiple data lines, and multiple scan lines. Each scan line is coupled to multiple pixel groups. Each pixel group includes pixels distributed in two adjacent pixel rows. The display driving circuit includes multiple first output nodes, multiple second output nodes, and a switch control circuit. The multiple first output nodes are respectively configured to be coupled to multiple first data lines among data lines of the display panel. The multiple second output nodes are respectively configured to be coupled to multiple second data lines among the data lines of the display panel. The switch control circuit is configured to generate multiple control signals. During a charge reuse period after a first pixel row among the pixel rows has displayed and before a second pixel row of the next pixel column of the first pixel row displays, at least part of the first output nodes are short-circuited to a first common node and at least part of the second output nodes are short-circuited to a second common node different from the first common node according to the control signals.

Based on the above, based on changing the special coupling relationship between the multiple pixels, the multiple data lines, and the multiple scan lines of the display panel, and controlling the multiple switches through the switch control circuit, the data voltages output by output channels (data lines) may be short-circuited together in a charge reuse period. In this way, a charge recovery action may be performed in the charge reuse period to reduce the power consumption of the display panel.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

The disclosure may change the coupling relationship between multiple pixels, multiple data lines, and multiple scan lines of the display panel, so that data voltages output through output channels (data lines) during the same scan line period may include data voltages with large grayscale value difference to facilitate the execution of a charge recovery mechanism.

Figure 1:
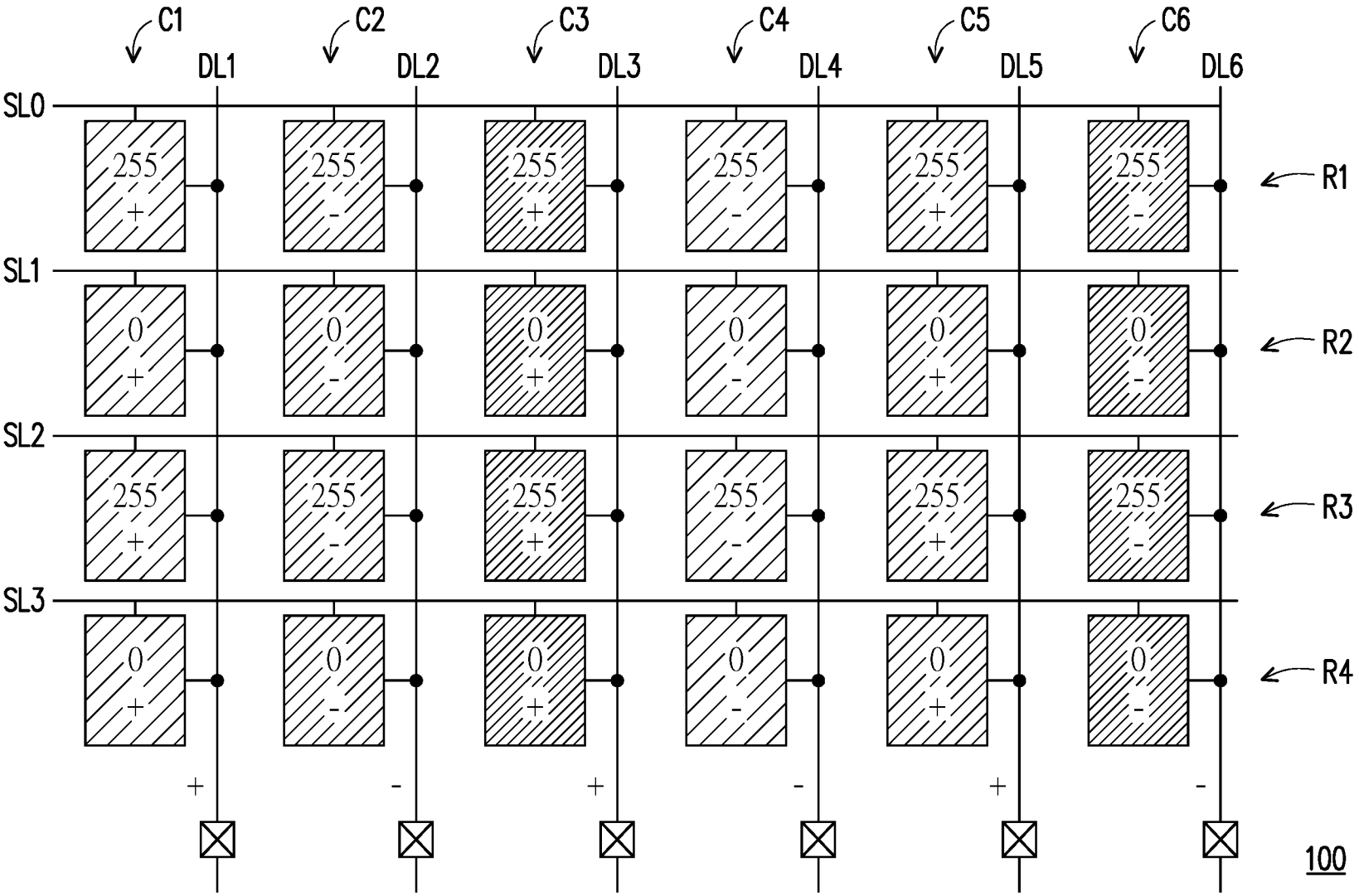
FIG. 1 (PRIOR ART)
FIG. 1 is a schematic diagram of a display panel displaying "H line".
Figure 2:
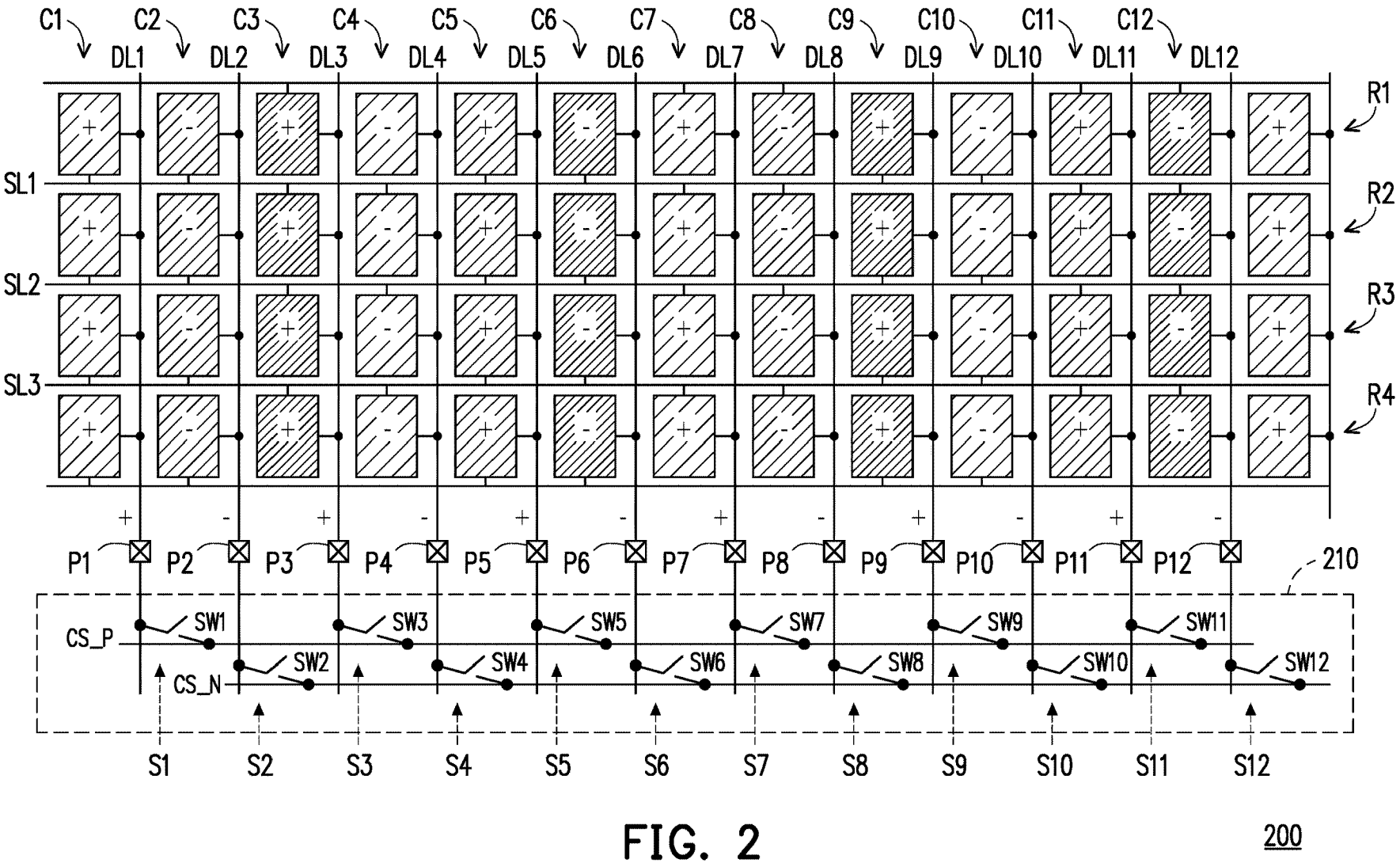
FIG. 2 is a schematic diagram of a pixel array of a display panel according to a first embodiment of the disclosure.

FIG. 2 is a schematic diagram of a pixel array of a display panel according to a first embodiment of the disclosure. In the first embodiment, a source driving circuit (not shown) includes multiple output nodes, and the multiple output nodes are respectively coupled to multiple data lines. The charge recovery mechanism of the first embodiment is based on a group of 12 data channels (data lines DL1 to DL12). The arrangement of pixel polarity on the display panel may be regarded as the same as column inversion. The key point of FIG. 2 is that pixels coupled to any scan line are distributed in different adjacent pixel rows, and the pixels coupled to any data line are distributed in the same pixel column. Please refer to FIG. 2. A display panel 200 includes multiple data lines (such as DL1 to DL12), multiple scan lines (such as SL1 to SL3), and a pixel array composed of multiple pixel columns (such as C1 to C12) and multiple pixel rows (such as R1 to R4). In FIG. 2, "+" and "−" respectively represent a positive-polarity data voltage and a negative-polarity data voltage. According to the color to be displayed, pixels are marked with different textures. For example, pixels to display red are represented by sparse diagonal lines, pixels to display green are represented by dense diagonal lines, and pixels to display blue are represented by denser diagonal lines.

As shown in FIG. 2, a switch group 210 includes multiple switches SW1 to SW12. In one embodiment, the switch group 210 may be implemented in a source driver (a.k.a. data driver). The switches SW1 to SW12 are respectively coupled to one end of multiple nodes P1 to P12 which may be as output nodes (i.e. output pins) of the source driver, and the multiple data lines DL1 to DL12 are respectively coupled to the other end of the multiple nodes P1 to P12. Each switch is coupled between a common node (a first common node CS_P or a second common node CS_N) and a data line. The odd-numbered switches SW1, SW3, SW5, SW7, SW9, and SW11 are configured to short-circuit data channels (data lines) outputting positive-polarity data voltages. The even-numbered switches SW2, SW4, SW6, SW8, SW10, and SW12 are configured to short-circuit data channels (data lines) outputting negative-polarity data voltages. The switching actions of the switches SW1 to SW12 are respectively controlled by control signals S1 to S12. Benefit from the fact that the pixels coupled to any scan line are distributed in different adjacent pixel rows and the pixels coupled to any data line are distributed in the same pixel column, through controlling the switches SW1 to SW12, after the current scan line period, at least six data lines with the same output polarity and large grayscale value difference may be short-circuited together (for example, short-circuited to the first common node CS_P or the second common node CS_N) to obtain an initial data voltage (or said a beginning data voltage for the next scan line period) corresponding to an intermediate grayscale value. In this way, the source driver may enable the data lines which are short-circuited (after charging/discharging to the date lines in the current scan line period have been completed) to be charged from the initial data voltage corresponding to the intermediate grayscale value during the next scan line period, so as to achieve the objective of power saving through the charge recovery mechanism.

Figure 3A:
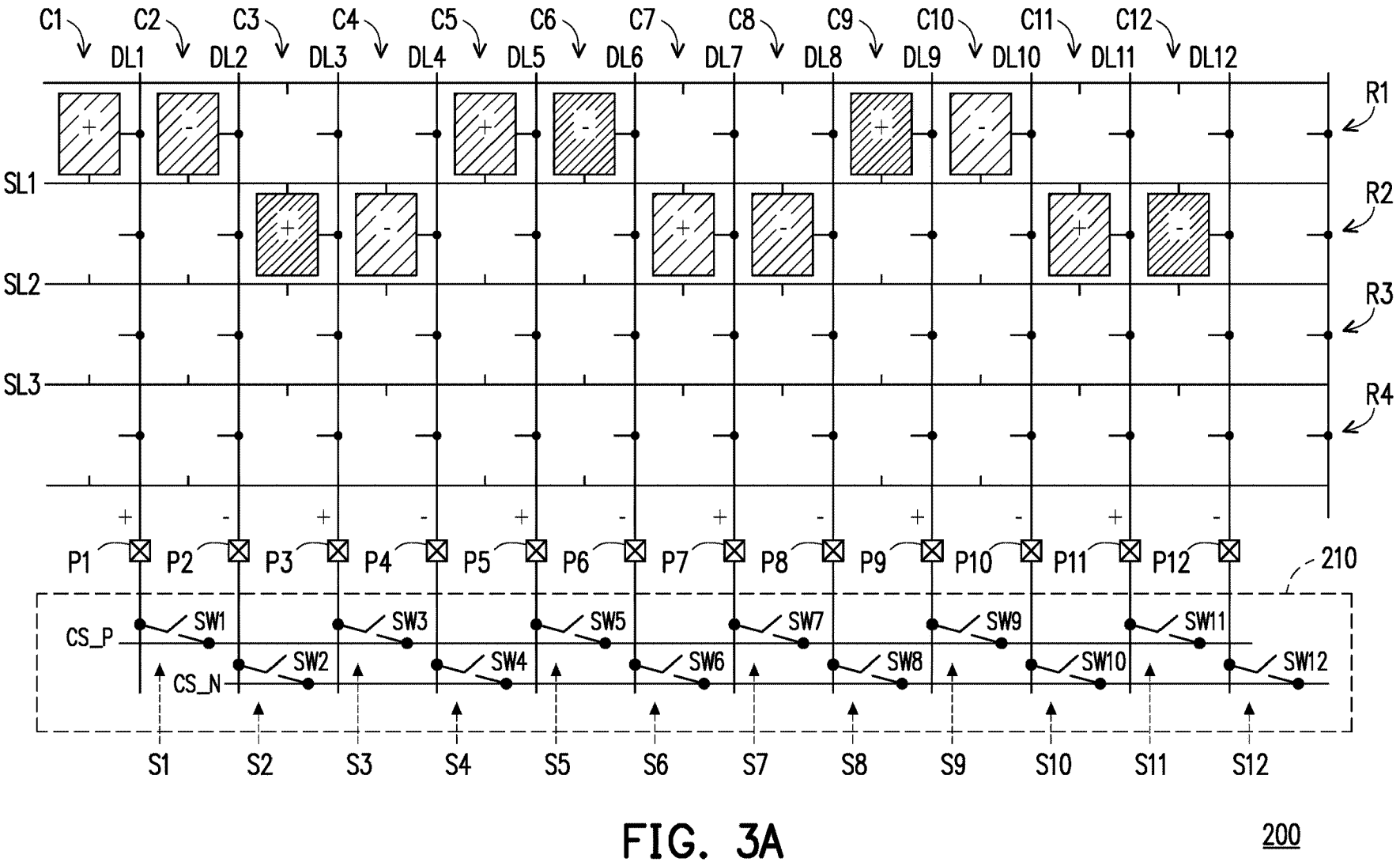
FIG. 3A to FIG. 3C are schematic diagrams of coupling relationship between multiple data lines, multiple scan lines, and the pixel array according to the first embodiment.
Figure 3B:
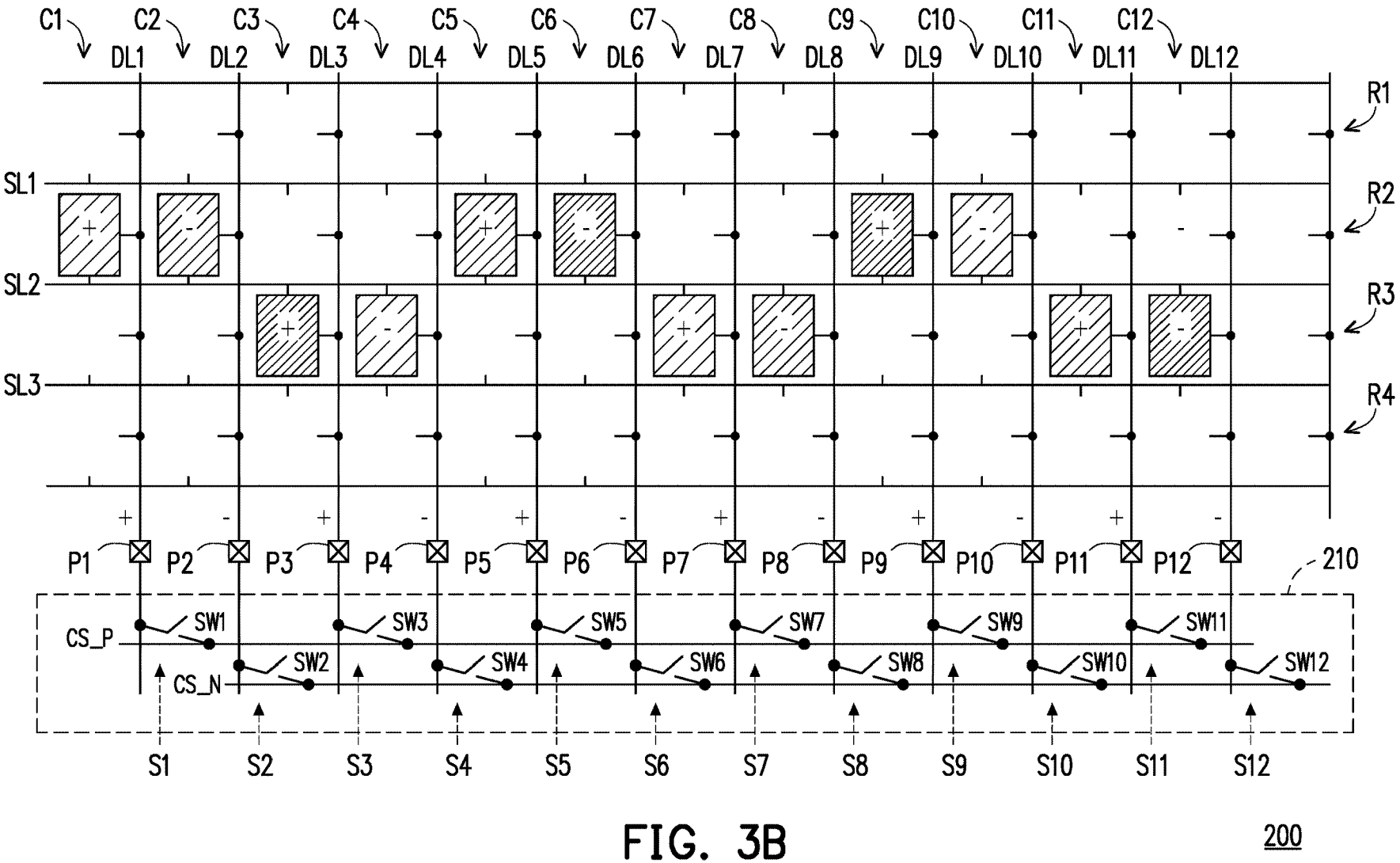
Figure 3C:
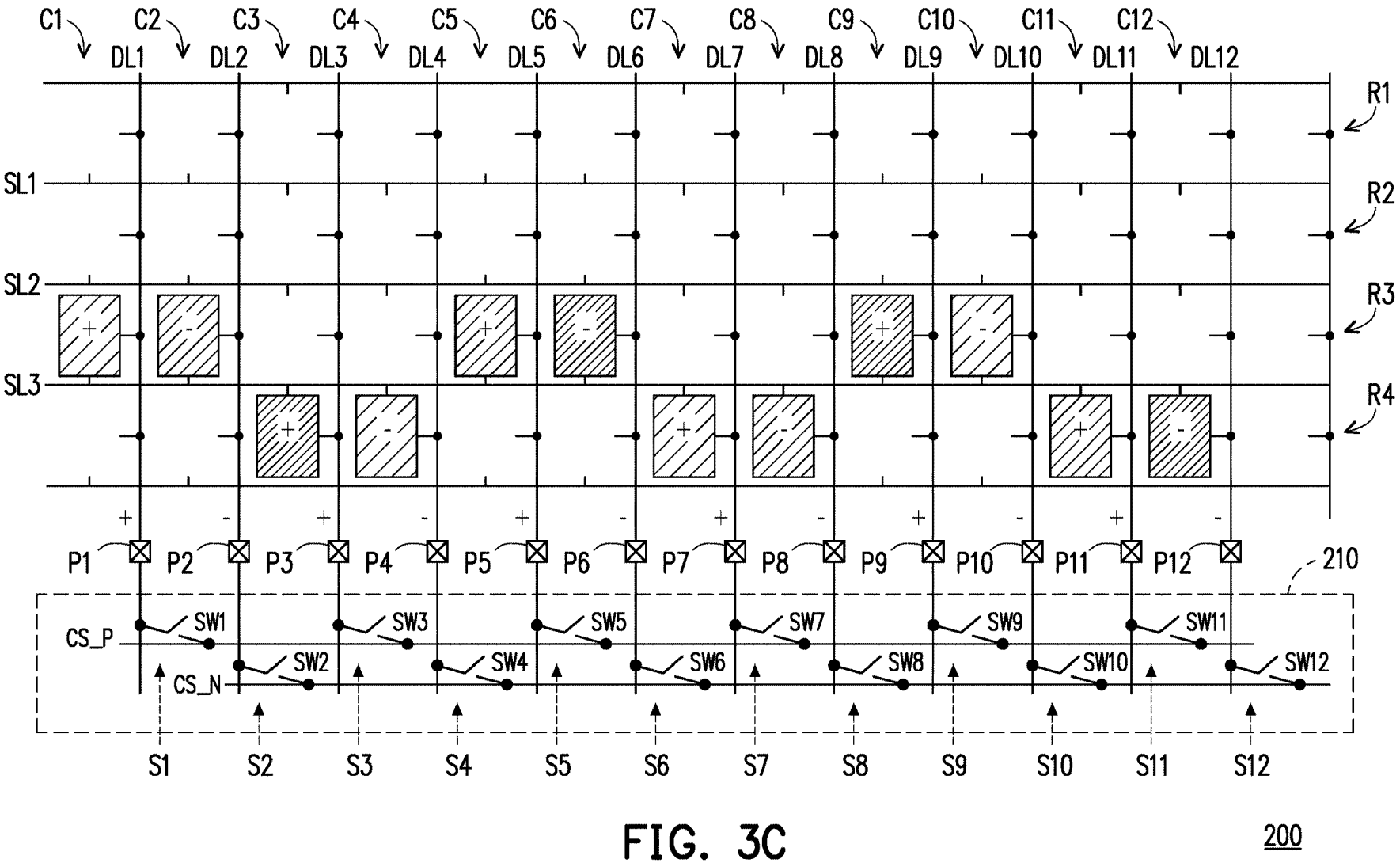

The key point of FIG. 2 is that pixels coupled to any scan line are distributed in different adjacent pixel rows, and the pixels coupled to any data line are distributed in the same pixel column. Below, FIG. 3A to FIG. 3C will be used to illustrate the coupling relationship between the multiple data lines, the multiple scan lines, and the pixel array. FIG. 3A to FIG. 3C are schematic diagrams of the coupling relationship between the multiple data lines, the multiple scan lines, and the pixel array according to the first embodiment. In order to facilitate the illustration and for the drawings to be more concise, FIG. 3A to FIG. 3C only respectively illustrate the pixels coupled to the scan lines SL1 to SL3. However, in reality, the structures shown in FIG. 3A to FIG. 3C are no different from FIG. 2.

As shown in FIG. 3A, the pixels coupled to the scan line SL1 are distributed in the pixel row R1 and the pixel row R2. The pixel row R1 and the pixel row R2 are adjacent pixel rows. It can be seen that the arrangement of the pixels coupled to the scan line SL1 shown on the screen is similar in a horizontal direction to a zigzag shape. As shown in FIG. 3B, the pixels coupled to the scan line SL2 are distributed in the pixel row R2 and the pixel row R3. The pixel row R2 and the pixel row R3 are adjacent pixel rows. It can be seen that the arrangement of the pixels coupled to the scan line SL2 shown on the screen is similar to the zigzag shape in the horizontal direction. As shown in FIG. 3C, the pixels coupled to the scan line SL3 are distributed in the pixel row R3 and the pixel row R4. The pixel row R3 and the pixel row R4 are adjacent pixel rows. It can be seen that the arrangement of the pixels coupled to the scan line SL3 shown on the screen is also similar to the zigzag shape in the horizontal direction. In simple terms, two adjacent rows of pixels of the display panel 200 are connected to corresponding scan lines in a zigzag manner.

Figure 4:
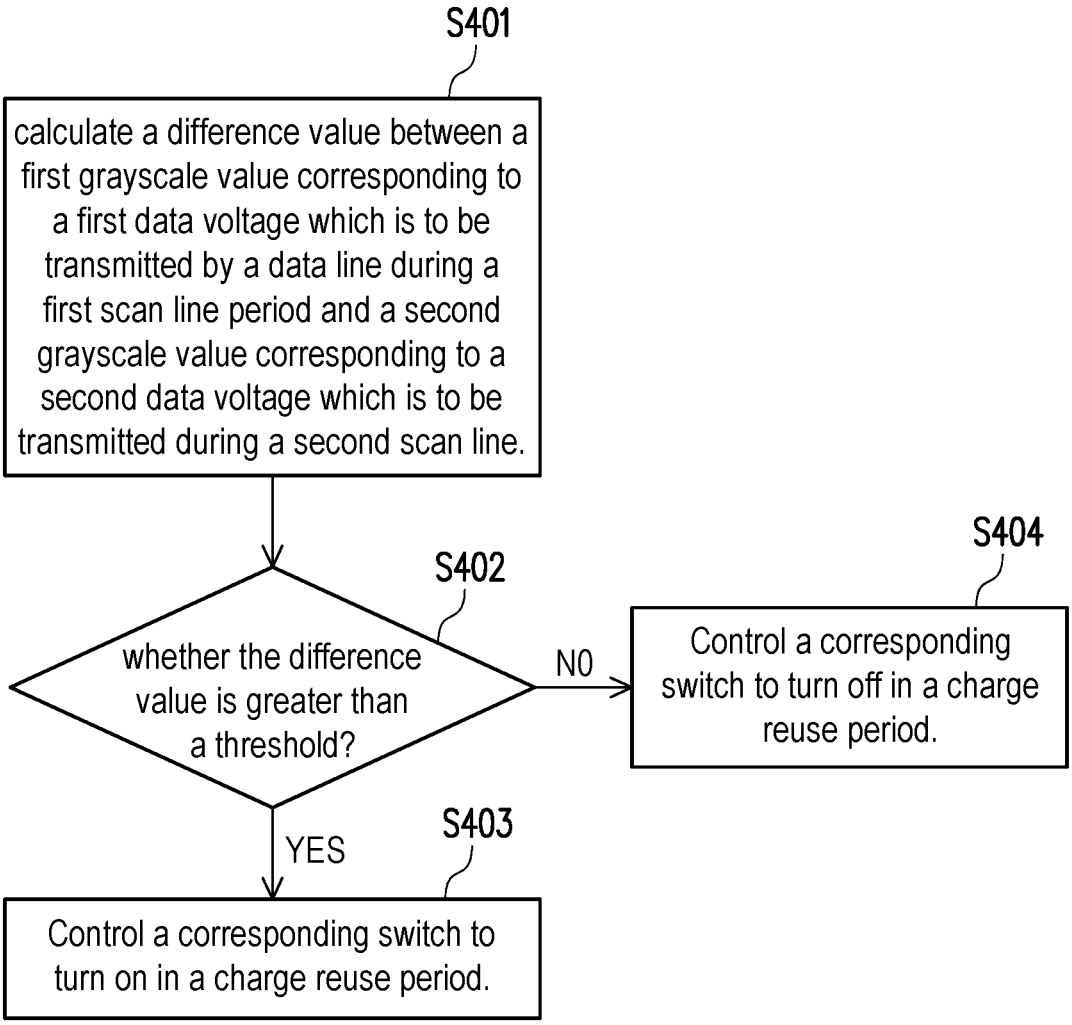
FIG. 4 shows a flowchart of steps for operating a switch group according to the first embodiment.

FIG. 4 shows a flowchart of steps for operating a switch group according to the first embodiment. Please refer to FIG. 4. In Step S401, a difference value between a first grayscale value corresponding to a first data voltage which is to be transmitted by a data line during a first scan line period and a second grayscale value corresponding to a second data voltage which is to be transmitted during a second scan line period is calculated. In Step S402, whether the difference value is greater than a threshold is confirmed. If yes, a corresponding switch is controlled to be turned on in a charge reuse period (Step S403), which may be a short period of time included in each scan line period and positioned after the charging/discharge to a current display line has been completed. In this disclosure, the charge reuse period is also expressed as a short period of time which is after a current (first) pixel row (a.k.a. a display line) has displayed and before a next (second) pixel row displays. If not, the corresponding switch is controlled to be turned off (Step S404). Based on such operating criterion, multiple test patterns including "H line" will be described in the following. The first scan line period may be regarded as the current scan line period, and the second scan line period may be regarded as the next scan line period. The threshold may be set based on the image content that is displayed with high power consumption and may be set based on the degree of power saving requirement to the display panel. In an example, in the case of 8-bit data resolution, the threshold may be set to 127 (which means the charge recovery function is enabled as long as the grayscale difference between the grayscale values corresponding to two data voltages to be transmitted by the same data line during two consecutive scan line periods is greater than a half of the highest grayscale value), or set to 255 (which means the charge recovery function is enabled only in response to an extreme case as displaying H lines).

Figure 5:
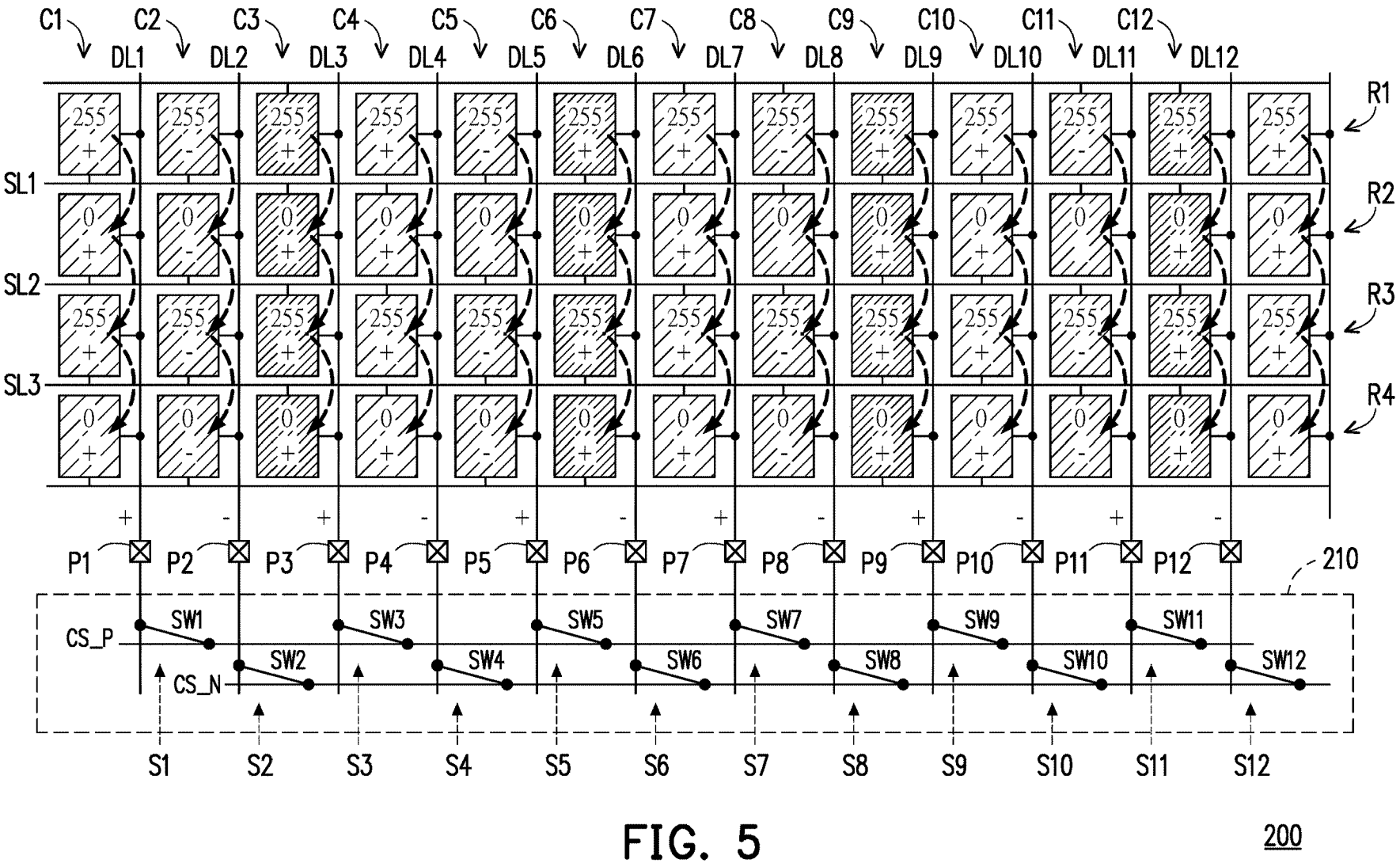
FIG. 5 is a schematic diagram of displaying "H line" on the display panel of the first embodiment.

FIG. 5 is a schematic diagram of displaying "H line" on the display panel of the first embodiment. It can be seen from FIG. 5 that data voltages of the pixel rows R1 and R3 both correspond to the grayscale value 255, and data voltages of the pixel rows R2 and R4 both correspond to the grayscale value 0. That is to say, as the scan line period advances, the data voltages output by the source driver (not shown) of the display panel 200 via the multiple data lines DL1 to DL12 transit between the grayscale value 255 and the grayscale value 0. Specifically, during the first scan line period, the pixel row R1 is turned on to receive the data voltages with the grayscale value 255. During the second scan line period, the pixel row R2 is turned on to receive the data voltages with the grayscale value 0. During a third scan line period, the pixel row R3 is turned on to receive the data voltages with the grayscale value 255. During a fourth scan line period, the pixel row R4 is turned on to receive the data voltages with the grayscale value 0. The grayscale values 255 and 0 are respectively the maximum and minimum grayscale values based on 8-bits data resolution. In this way, the display screen may show a pattern with alternating black and white horizontal stripes.

A switch control circuit (not shown) is configured to generate the control signals S1 to S12 to respectively control the switches SW1 to SW12. The switch control circuit may calculate the difference value between a first grayscale value corresponding to the first data voltage to be transmitted by a data line during the N-th scan line period and a second grayscale value corresponding to the second data voltage to be transmitted by the same data line during the (N+1)-th scan line period, where N is a positive integer. Specifically, the switch control circuit may calculate the difference value between the first grayscale value and the second grayscale value to determine whether the switches SW1 to SW12 are turned on or turned off. It should be noted that the grayscale values to be converted to data voltages to be transmitted by the data line during the current scan line period and the next scan line period may be stored in a register of the source driver. Taking the data line DL1 as an example, during the first scan line period (assumed to be the current scan line period), the data voltage transmitted by the data line DL1 has the grayscale value 255. During the next scan line period (that is, the second scan line period), the data voltage transmitted by the data line DL1 is expected to have the grayscale value 0. In this case, the switch control circuit may calculate the difference value between the two grayscale values and judge that the difference value is greater than a threshold to control the switch SW1 to be turned on through the control signal S1.

In this way, during a charge reuse period, the data line DL1 is short-circuited to the first common node CS_P due to the switch SW1 being turned on. At the same time, based on the same pattern, the data lines DL3, DL5, DL7, DL9, and DL11 are also respectively short-circuited to the first common node CS_P due to the switches SW3, SW5, SW7, SW9, and SW11 being turned on. Similarly, during the charge reuse period, the data lines DL2, DL4, DL6, DL8, DL10, and DL12 are also short-circuited to the second common node CS_N due to the switches SW2, SW4, SW6, SW8, SW10, and SW12 being turned on. Simply put, when displaying "H line", from every current scan line period to its next scan line period, the data voltage of any data line transits as indicated by the dotted arrow, which is to transit from the data voltage corresponding the grayscale value 255 to the data voltage corresponding the grayscale value 0 or from the data voltage corresponding the grayscale value 0 to the data voltage corresponding the grayscale value 255. Therefore, the switches SW1 to SW12 are all turned on in the charge reuse period to activate the charge recovery mechanism.

Please refer to FIG. 3A and FIG. 5 at the same time. During the charge reuse period, the data voltages of the data lines DL1, DL3, DL5, DL7, DL9, and DL11 are respectively short-circuited to the first common node CS_P due to the switches SW1, SW3, SW5, SW7, SW9, and SW11 being turned on. In other words, there are three data lines outputting the positive-polarity data voltages corresponding to the grayscale value 255 and three data lines outputting the positive-polarity data voltages corresponding to the grayscale value 0 being short-circuited together to the first common node CS_P during the charge reuse period, to obtain a positive-polarity initial data voltage corresponding to a middle grayscale value 128. At the same time, the data voltages of the data lines DL2, DL4, DL6, DL8, DL10, and DL12 are also respectively short-circuited to the second common node CS_N due to the switches SW2, SW4, SW6, SW8, SW10, and SW12 being turned on. That is to say, there are three data lines outputting the negative-polarity data voltages corresponding to the grayscale value 255 and three data lines outputting the negative-polarity data voltages corresponding to the grayscale value 0 being short-circuited together to the second common node CS_N during the charge reuse period, to obtain a negative-polarity initial data voltage corresponding to a middle grayscale value 128.

Please refer to FIG. 3B and FIG. 5 at the same time. During the charge reuse period, the first common node CS_P will obtain the initial data voltage equivalent to the grayscale value 128 due to the switches being turned on. At the same time, the second common node CS_N will also obtain the initial data voltage equivalent to the grayscale value 128 due to the switches being turned on. Please refer to FIG. 3C and FIG. 5 at the same time. After the third scan line period but before entering the fourth scan line period, the first common node CS_P will obtain the initial data voltage equivalent to the grayscale value 128 due to the switches being turned on. At the same time, the second common node CS_N will also obtain the initial data voltage equivalent to the grayscale value 128 due to the switches being turned on. In this way, the source driver may enable the data lines of the display panel 200 which are short-circuited during a charge reuse period to be charged from the initial data voltage corresponding to the intermediate grayscale value during the next scan line period. Since the grayscale value 128 is between the grayscale value 0 and the grayscale value 255, an initial data voltage corresponding to the grayscale value 128 is more close to a next target data voltage corresponding to the grayscale value 255 (or 0) than the current target data voltage corresponding to the grayscale value 0 (or 255), such that the amount of charges for achieving charging or discharging data lines in the next scan line period are reduced, and the optimal power saving effect may be achieved.

Figure 6:
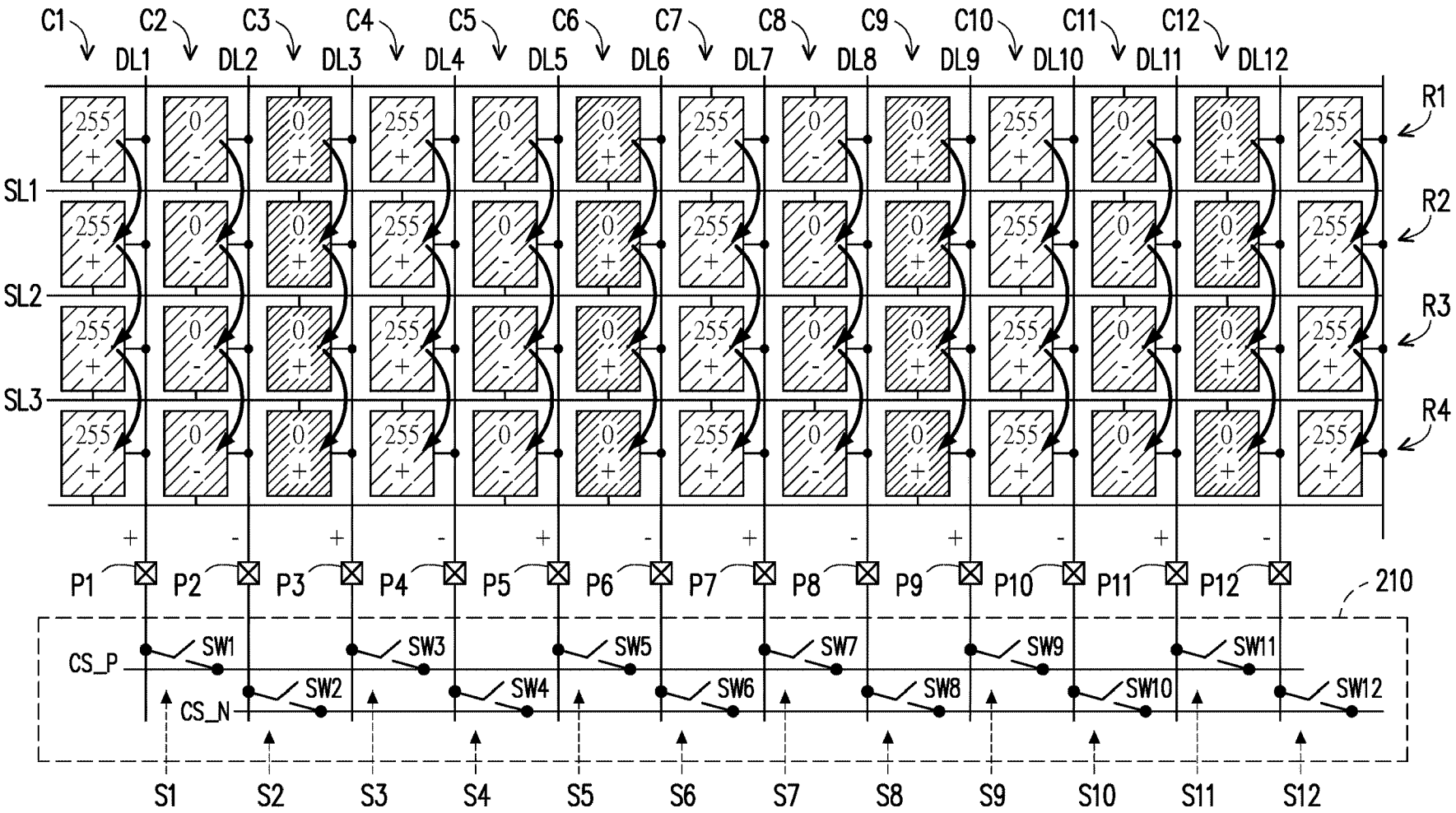
FIG. 6 is a schematic diagram of displaying "R pattern" on the display panel of the first embodiment.

FIG. 6 is a schematic diagram of displaying a red test pattern (hereinafter referred to as "R pattern") on the display panel of the first embodiment. It can be seen from FIG. 6 that the pixels of the pixel columns C1, C4, C7, and C10 are all pixels to display red and the grayscale values thereof are all 255. The grayscale values of the pixels (pixels to display green, that is, blue) of the pixel columns C2, C3, C5, C6, C8, C9, C11, and C12 are all 0. Thereby, the display panel 200 may display "R pattern". It can be seen that when displaying "R pattern", with respect to each data line, the data voltage outputted to the data line from any current scan line period to its next scan line period does not change (as shown by the solid arrows). Therefore, the switches SW1 to SW12 are all turned off in the charge reuse period. In other words, when displaying "R pattern", there is no need to activate the charge recovery mechanism.

Figure 7:
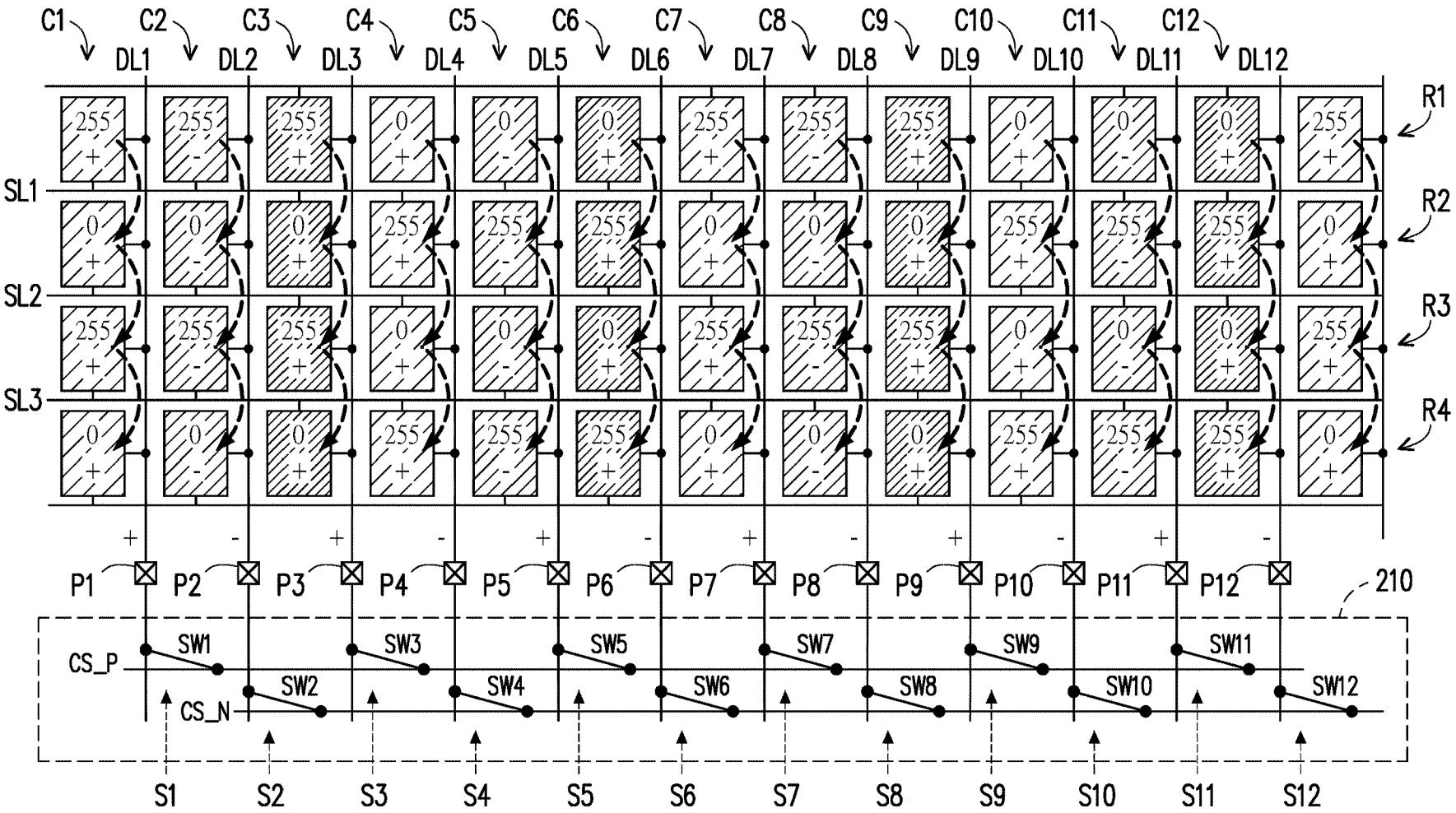
FIG. 7 is a schematic diagram of displaying "Checker pattern" on the display panel of the first embodiment.

FIG. 7 is a schematic diagram of a checkerboard test pattern (hereinafter referred to as a Checker pattern) displayed on the display panel of the first embodiment. It can be seen from FIG. 7 that among the pixels of the pixel row R1, the pixels interlaced with the pixel columns C1 to C3, C7 to C9, and C13 all display the grayscale value 255, and the pixels interlaced with the pixel columns C4 to C6 and C10 to C12 all display the grayscale value 0. Among the pixels of the pixel row R2, the pixels interlaced with the pixel columns C1 to C3, C7 to C9, and C13 all display the grayscale value 0, and the pixels interlaced with the pixel columns C4 to C6 and C10 to C12 all display the grayscale value 255. Among the pixels of the pixel row R3, the pixels interlaced with the pixel columns C1 to C3, C7 to C9, and C13 all display the grayscale value 255, and the pixels interlaced with the pixel columns C4 to C6 and C10 to C12 all display the grayscale value 0. Among the pixels of the pixel row R4, the pixels interlaced with the pixel columns C1 to C3, C7 to C9, and C13 all display the grayscale value 0, and the pixels interlaced with the pixel columns C4 to C6 and C10 to C12 all display the grayscale value 255. Thereby, the display panel 200 may display "Checker pattern".

It can be seen that when displaying a Checker pattern, with respect to each data line, the data voltage outputted to the data line from any current scan line period to its next scan line period transits from the grayscale value 255 to 0 or from 0 to 255. Therefore, the switches SW1 to SW12 are all turned on in the charge reuse periods to activate the charge recovery mechanism. Please refer to FIG. 3A to FIG. 3C and FIG. 7 at the same time. For the first common node CS_P and the second common node CS_N, during the charge reuse periods, there will three data lines outputting the same-polarity data voltages corresponding to the grayscale value 255 and three data lines outputting the same-polarity data voltages corresponding to the grayscale value 0 being short-circuited together. The first common node CS_P will obtain the initial data voltage corresponding to the grayscale value 128 due to the switches being turned on. Similarly, during the charge reuse periods, the second common node CS_N will also obtain the initial data voltage corresponding to the grayscale value 128 due to the switches being turned on. In this way, the source driver may enable the data lines of the display panel which are short-circuited during a charge reuse period to be charged from the initial data voltage corresponding to the intermediate grayscale value during the next scan line period. Since the grayscale value 128 is between the grayscale value 0 and the grayscale value 255, an initial data voltage corresponding to the grayscale value 128 is more close to a next target data voltage corresponding to the grayscale value 255 (or 0) than the current target data voltage corresponding to the grayscale value 0 (or 255), such that the amount of charges for achieving charging or discharging data lines in the next scan line period are reduced, and, the optimal power saving effect may be achieved.

Figure 8:
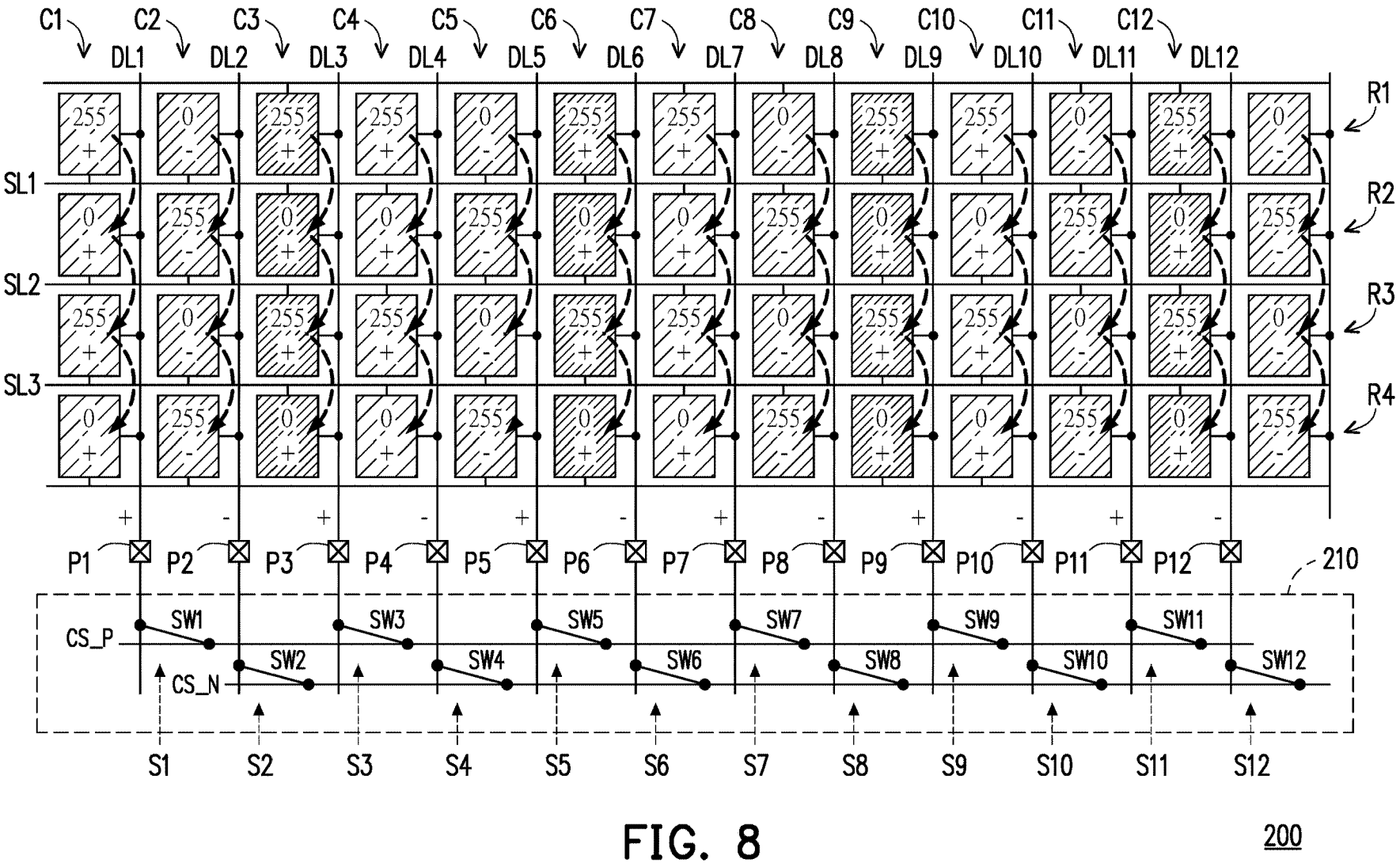
FIG. 8 is a schematic diagram of displaying "Sub Checker pattern" on the display panel of the first embodiment.

FIG. 8 is a schematic diagram of displaying a sub-checkerboard test pattern (hereinafter referred to as "Sub Checker pattern") on the display panel of the first embodiment. It can be seen from FIG. 8 that among the pixels of the pixel row R1, the pixels interlaced with the odd-numbered pixel columns all have the grayscale value 255, and the pixels interlaced with the even-numbered pixel columns all have the grayscale value 0. Among the pixels of the pixel row R2, the pixels interlaced with the odd-numbered pixel columns all display the grayscale value 0, and the pixels interlaced with the even-numbered pixel columns all display the grayscale value 255. Among the pixels of the pixel row R3, the pixels interlaced with the odd-numbered pixel columns all display the grayscale value 255, and the pixels interlaced with the even-numbered pixel columns all display the grayscale value 0. Among the pixels of the pixel row R4, the pixels interlaced with the odd-numbered pixel columns all display the grayscale value 0, and the pixels interlaced with the even-numbered pixel columns all display the grayscale value 255. In this way, the display panel 200 may display "Sub Checker pattern".

It can be seen that when displaying "Sub Checker pattern", with respect to each data line, the data voltage outputted to the data line from any current scan line period to its next scan line period transits from the grayscale value 255 to 0 or from 0 to 255. Therefore, the switches SW1 to SW12 are all turned on in the charge reuse period to activate the charge recovery mechanism. Please refer to FIG. 3A to FIG. 3C and FIG. 8 at the same time. For the first common node CS_P and the second common node CS_N, there will be three data lines outputting the same-polarity data voltages corresponding to the grayscale value 255 and three data lines outputting the same-polarity data voltages corresponding to the grayscale value 0 being short-circuited together during any charge reuse period. The first common node CS_P will obtain the initial data voltage corresponding to the grayscale value 128 due to the switches being turned on. At the same time, the second common node CS_N will also obtain the initial data voltage corresponding to the grayscale value 128 due to the switches being turned on. In this way, the source driver may enable the data lines of the display panel which are short-circuited during a charge reuse period to be charged from the initial data voltage corresponding to the intermediate grayscale value during the next scan line period. Since the grayscale value 128 is between the grayscale value 0 and the grayscale value 255, an initial data voltage corresponding to the grayscale value 128 is more close to a next target data voltage corresponding to the grayscale value 255 (or 0) than the current target data voltage corresponding to the grayscale value 0 (or 255), such that the optimal power saving effect may be achieved.

Figure 9:
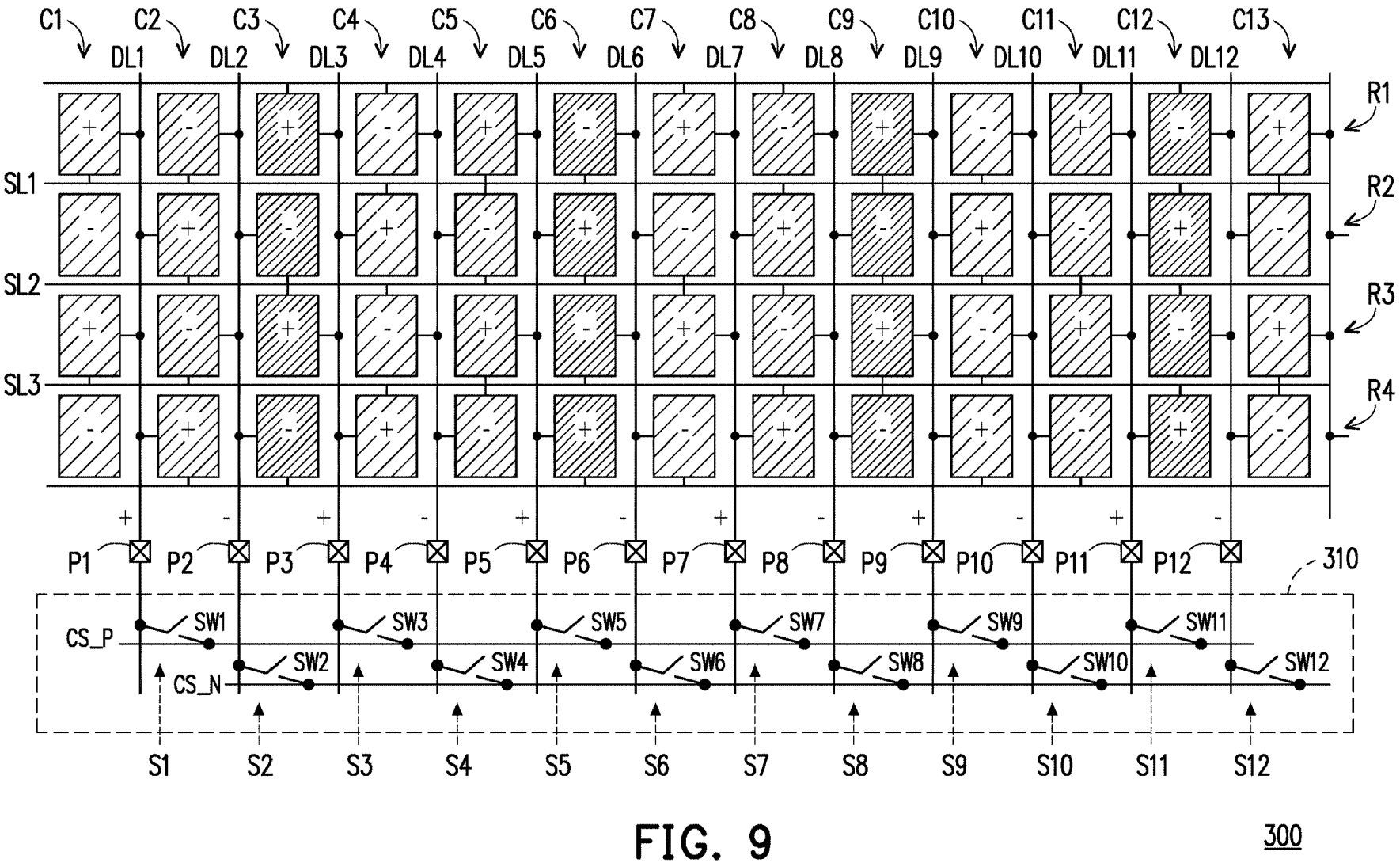
FIG. 9 is a schematic diagram of a pixel array of a display panel according to a second embodiment of the disclosure.

FIG. 9 is a schematic diagram of a pixel array of a display panel according to a second embodiment of the disclosure. The charge recovery mechanism of the second embodiment is still based on a group of 12 data channels (data lines DL1 to DL12). In the second embodiment, the arrangement of pixel polarity on the display panel is the same as dot inversion. However, the polarity of the data voltage output by the source driver via each data channel does not change by scan line periods, which is regarded as a column inversion driving scheme for the data channels. On the other hand, since the output of the data channels does not require polarity inversion, the display panel have a better power saving effect. As shown in FIG. 9, a display panel 300 includes multiple data lines (such as DL1 to DL12), multiple scan lines (such as SL1 to SL3), and a pixel array composed of multiple pixel columns (such as C1 to C13) and multiple pixel rows (such as R1 to R4). Please refer to FIG. 2 and FIG. 9 at the same time. The difference between the second embodiment (FIG. 9) and the first embodiment (FIG. 2) is only the coupling relationship between the multiple data lines, the multiple scan lines, and the pixel array. In the first embodiment, each data line is only coupled to multiple pixels located in the same pixel column, and each scan line is coupled to multiple pixels located in two adjacent pixel rows. However, in the second embodiment, each data line is coupled to multiple pixels located in two adjacent pixel columns, and each scan line is coupled to multiple pixels located in two adjacent pixel rows. For example, the data line D1 is coupled to pixel columns C1 and C2 so as to output data voltages to a part of pixels of the pixel columns C1 and a part of pixels of the pixel columns C2, the data line D2 is coupled to pixel columns C2 and C3 so as to output data voltages to a part of pixels of the pixel columns C2 and a part of pixels of the pixel columns C3, and so on.

Figure 10A:
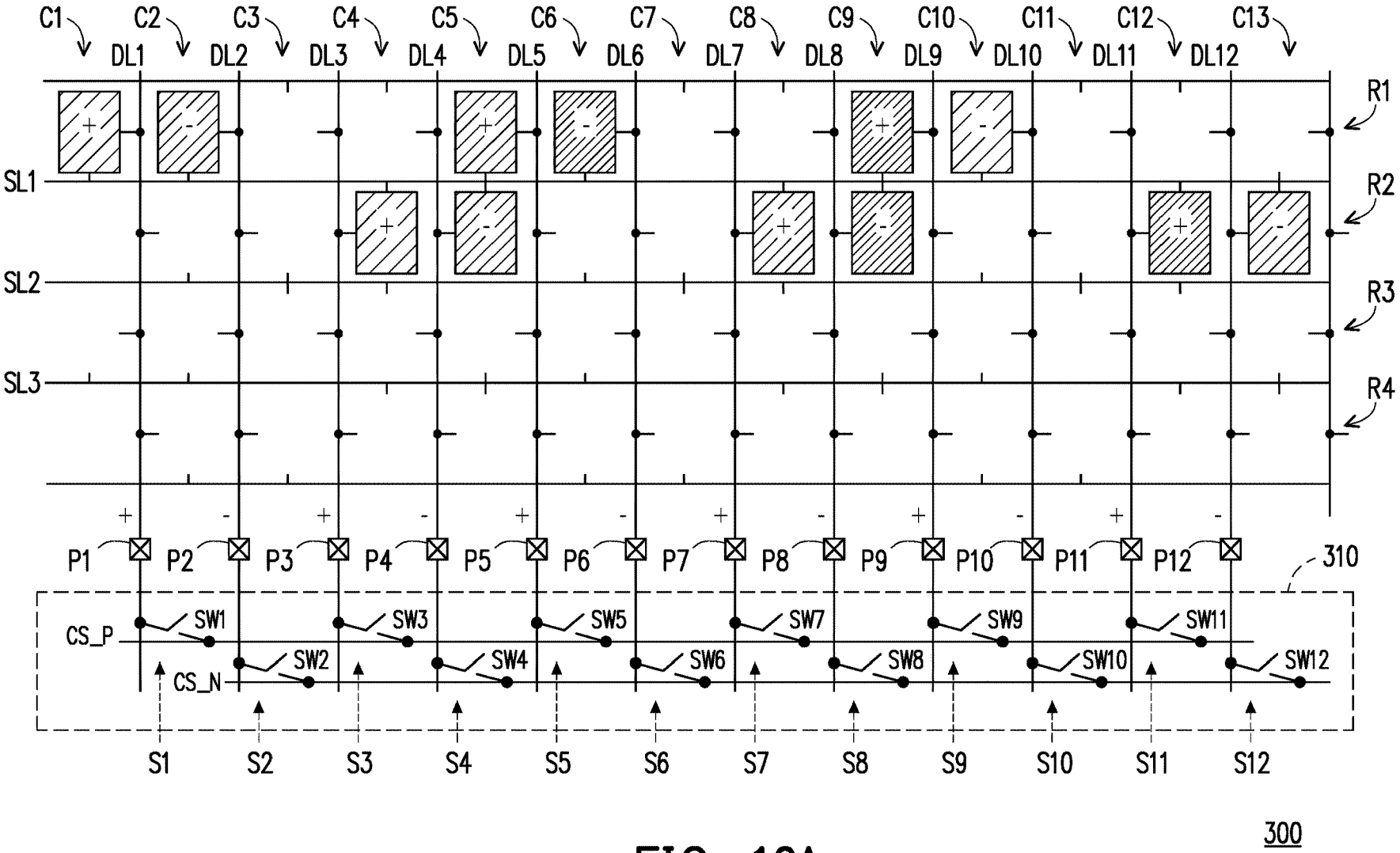
FIG. 10A to FIG. 10C are schematic diagrams of coupling relationship between multiple data lines, multiple scan lines, and the pixel array according to the second embodiment.
Figure 10B:
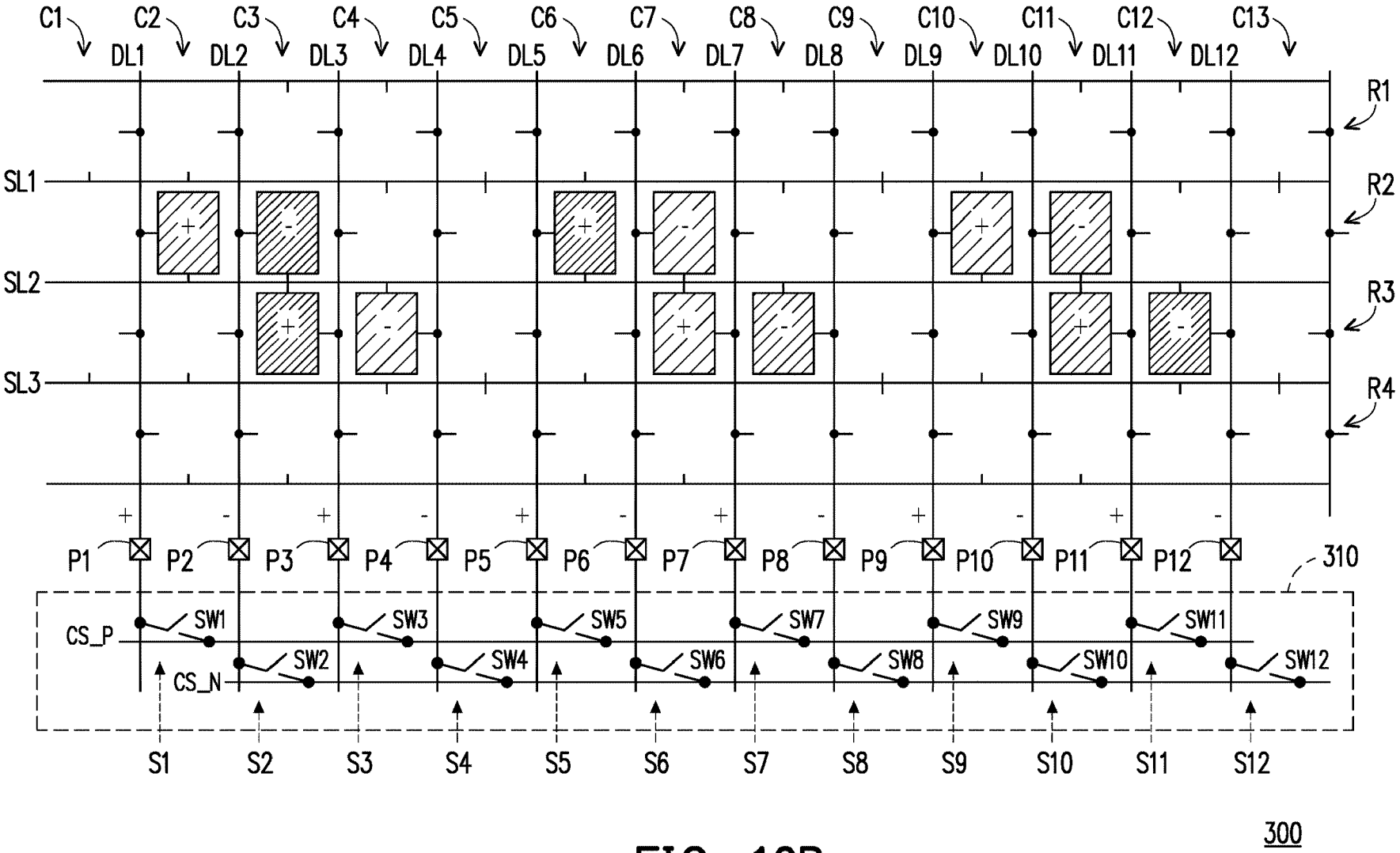
Figure 10C:
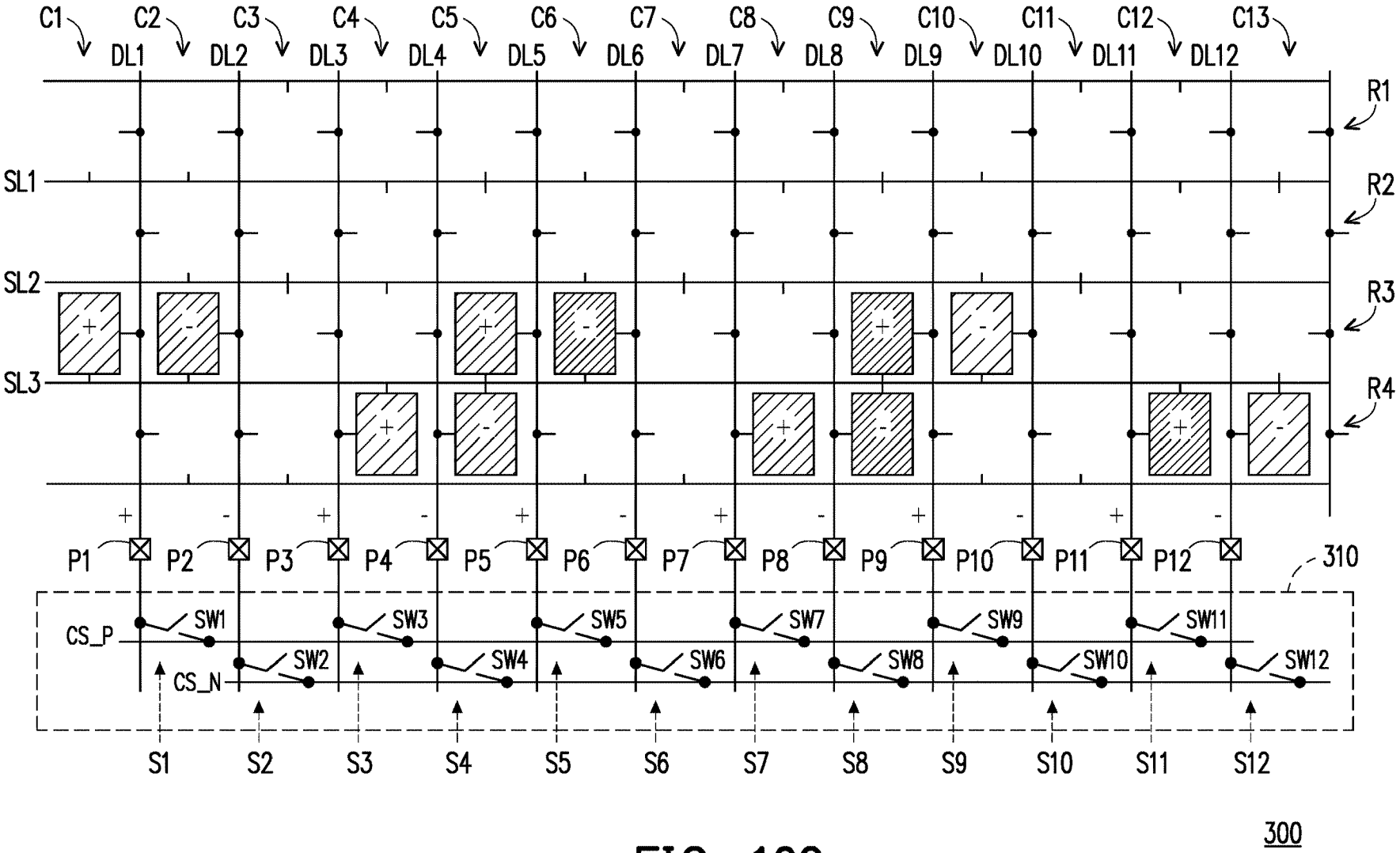

FIG. 10A to FIG. 10C are schematic diagrams of coupling relationship between multiple data lines, multiple scan lines, and a pixel array according to the second embodiment. In order to facilitate the illustration and for the drawings to be more concise, FIG. 10A to FIG. 10C only respectively illustrate the pixels coupled to the scan lines SL1 to SL3. However, in reality, the structures shown in FIG. 10A to 10C are no different from FIG. 9. As shown in FIG. 10A, the pixels coupled by the scan line SL1 are distributed in the pixel row R1 and the pixel row R2 adjacent to the pixel row R1. It can be seen that the arrangement of the pixels coupled to the scan line SL1 shown on the screen is similar to the zigzag shape in the horizontal direction. In FIG. 10B and FIG. 10C, the arrangement of the pixels coupled to the scan lines SL2 and SL3 shown on the screen is also similar to the zigzag shape in the horizontal direction.

Furthermore, in terms of a single scan line (for example, the scan line SL1), there are still differences in the coupling manner between the scan line and the pixels. In the first embodiment, each scan line is alternately coupled to multiple pixels (in units of two adjacent pixels) of two adjacent pixel rows, as shown in FIG. 3A. In the second embodiment, each scan line is also alternately coupled to two adjacent pixel rows (in units of two adjacent pixels, but for a scan line, at least two pixels of the multiple pixels (distributed in two adjacent pixel rows) coupled to the scan line are located in the same pixel column. Taking FIG. 10A as an example, among the pixels coupled to the scan line SL1, two pixels are located in a pixel column, and two other pixels are located in the pixel column C9. It should be noted that in order to facilitate persons skilled in the art to understand the relative positions of multiple pixels from the drawings, the disclosure arranges the multiple pixels of the display panels of the first embodiment and the second embodiment in arrays. However, in practical applications, the multiple pixels of the display panels 200 and 300 are not necessarily aligned.

Figure 11:
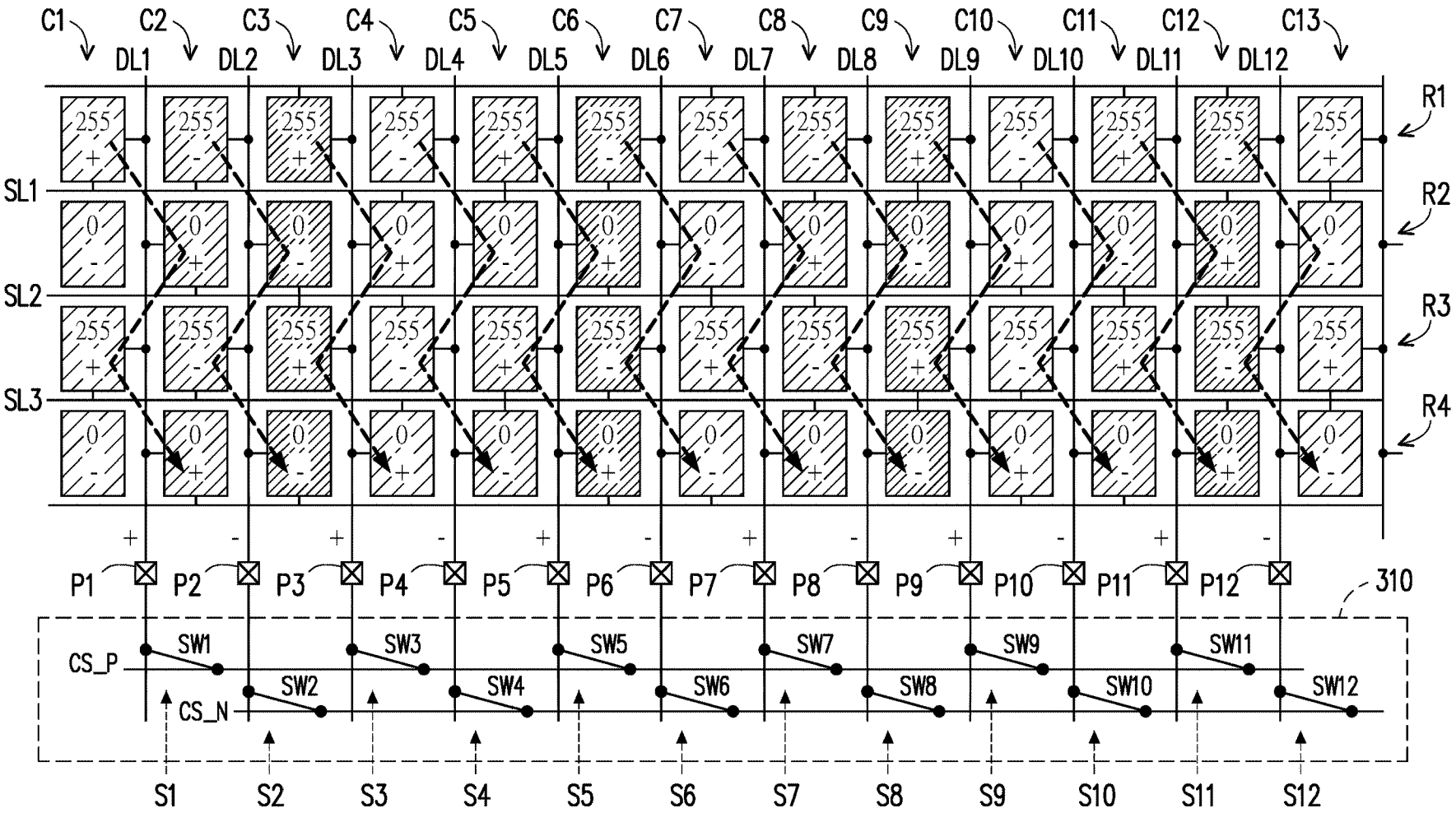
FIG. 11 is a schematic diagram of displaying "H line" on the display panel of the second embodiment.

FIG. 11 is a schematic diagram of displaying "H line" on the display panel of the second embodiment. It can be seen from FIG. 11 that as the scan line period advances, the grayscale values corresponding to the data voltages output by the source driver (not shown) of the display panel 300 via the multiple data lines DL1 to DL12 transit between the maximum grayscale value 255 and the minimum grayscale value 0. In this way, the display screen may show a pattern with alternating black and white horizontal stripes. Based on the operation method shown in FIG. 4, the switch control circuit (not shown) controls the switches SW1 to SW12 to be turned on in the charge reuse period, so as to activate the charge recovery mechanism. In the case where the charge recovery mechanism is activated, for the first common node CS_P and the second common node CS_N, there will be 3 three data lines outputting the same-polarity data voltages corresponding to the grayscale value 255 and three data lines outputting the same-polarity data voltages corresponding to the grayscale value 0 being short-circuited together to obtain an initial data voltage corresponding to a middle grayscale value 128.

Taking the scan line SL1 as an example, as referred to FIG. 10A and FIG. 11, there are three data lines DL1, DL5, DL9 outputting the positive-polarity data voltages corresponding to the grayscale value 255 and three data lines DL3, DL7, DL11 outputting the positive-polarity data voltages corresponding to the grayscale value 0 being short-circuited together to the first common node CS_P during the charge reuse period, to obtain a positive-polarity initial data voltage corresponding to a middle grayscale value 128; or, in another aspect, pixels driven by positive-polarity data voltages coupled to the scan line SL1 and located in the pixel columns C1, C4, C5, C8, C9, and C12 are short-circuited to the first common node CS_P. In addition, there are three data lines DL2, DL6, DL10 outputting the negative-polarity data voltages corresponding to the grayscale value 255 and three data lines DL4, DL8, DL12 outputting the negative-polarity data voltages corresponding to the grayscale value 0 being short-circuited together to the second common node CS_N during the charge reuse period, to obtain a negative-polarity initial data voltage corresponding to a middle grayscale value 128; or, in another aspect, pixels coupled to the scan line SL1 and located in the pixel columns C2, C5, C6, C9, C10, and C13 are short-circuited to the second common node CS_N. Charge recovery mechanism operated on any other scan line such as SL2 or SL3 may be referred to FIGS. 10B, 10C and 11, and the literal description is omitted herein. In this way, the source driver may enable the data lines of the display panel which are short-circuited during a charge reuse period to be charged from the initial data voltage corresponding to the intermediate grayscale value during the next scan line period, such that the amount of charges for achieving charging or discharging data lines in the next scan line period are reduced, so as to achieve the optimal power saving effect.

Figure 12:
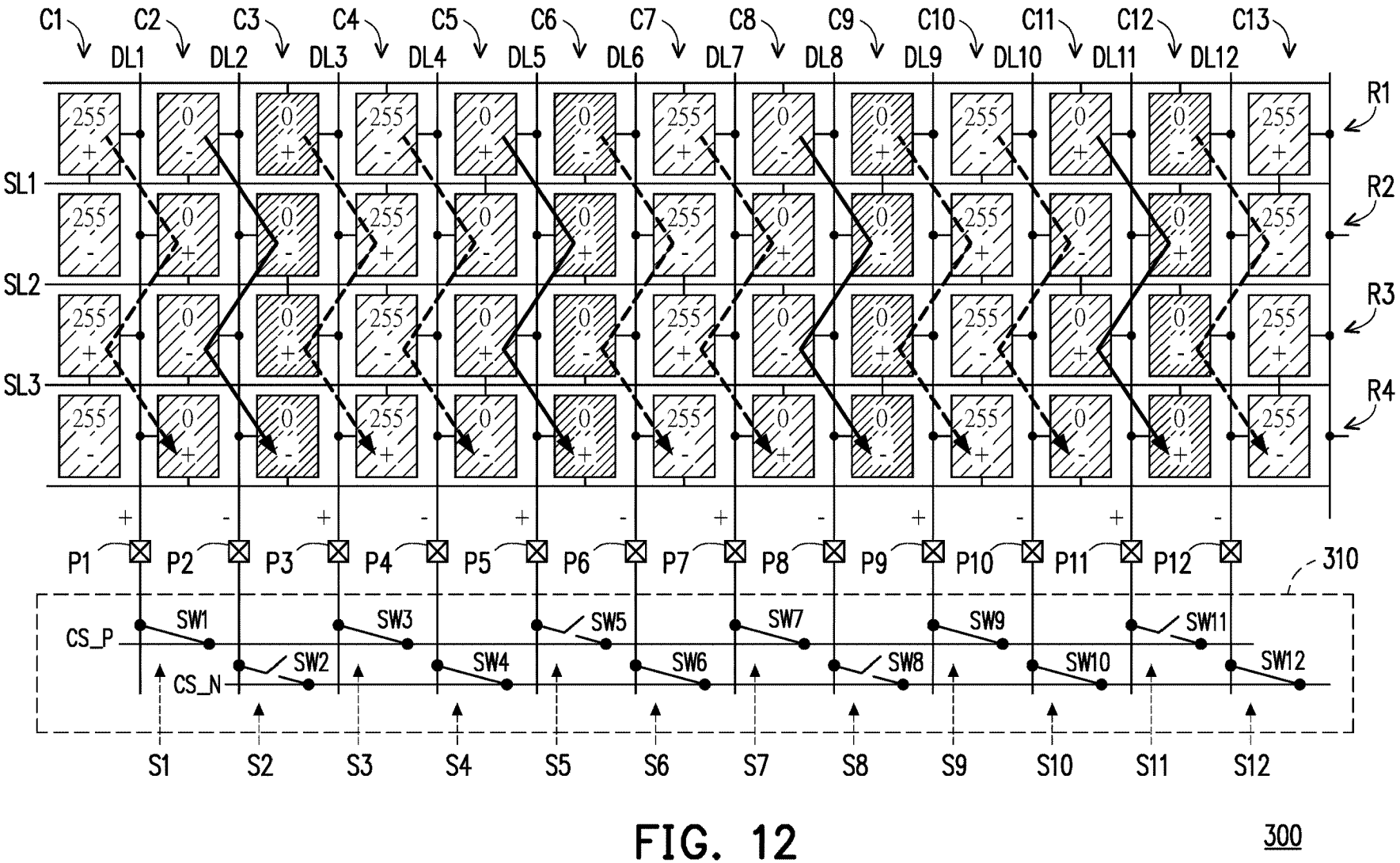
FIG. 12 is a schematic diagram of displaying "R pattern" on the display panel of the second embodiment.

FIG. 12 is a schematic diagram of displaying "R pattern" on the display panel of the second embodiment. As shown in FIG. 12, as the scan line period advances, the grayscale values corresponding to the data voltages output by the data lines DL1, DL3, DL4, DL6, DL7, DL9, DL10, and DL12 are as shown by the dotted arrows and transit between the maximum grayscale value 255 and the minimum grayscale value 0. As the scan line period advances, the data voltages output by the data lines DL2, DL5, DL8, and DL11 will not change as shown by the solid arrows. Therefore, the switch control circuit (not shown) controls the switches SW1, SW3, SW4, SW6, SW7, SW9, SW10, and SW12 to be turned on in the charge reuse period, so as to activate the charge recovery mechanism. At the same time, the switch control circuit controls the switches SW2, SW5, SW8, and SW11 to be turned off (the charge recovery mechanism does not need to be activated because the data voltages do not change). It is important to note that for the first common node CS_P and the second common node CS_N, there are two data lines outputting the same-polarity data voltages corresponding to the grayscale value 255 and two data lines outputting the same-polarity data voltages corresponding to the grayscale value 0 being short-circuited together to a respective common node during the charge reuse period, to obtain the initial data voltage with the grayscale value 128. Therefore, the optimal power saving effect may be achieved.

Specifically, taking the scan line SL1 as an example, the data lines DL1, DL3, DL7 DL9 outputting the positive-polarity data voltages are short-circuited to the first common node CS_P during the charge reuse period, and in other aspect, the pixels coupled to the scan line SL1 and located in the pixel columns C1, C4, C8, and C9 are short-circuited to the first common node CS_P during the charge reuse period. In addition, the data lines DL4, DL6, DL10, DL12 outputting the negative-polarity data voltages are short-circuited to the second common node CS_N during the charge reuse period, and in other aspect, the pixels coupled to the scan line SL1 and located in the pixel columns C5, C6, C10, and C13 are short-circuited to the second common node CS_N during the charge reuse period. Taking the scan line SL2 as an example, the data lines DL1, DL3, DL7 DL9 outputting the positive-polarity data voltages are short-circuited to the first common node CS_P during the charge reuse period, in other aspect, and in other aspect, the pixels coupled to the scan line SL2 and located in the pixel columns C2, C3, C7, and C10 are short-circuited to the first common node CS_P during the charge reuse period. In addition, the data lines DL4, DL6, DL10, DL12 outputting the negative-polarity data voltages are short-circuited to the second common node CS_N during the charge reuse period, and in other aspect, the pixels coupled to the scan line SL2 and located in the pixel columns C4, C7, C11, and C12 are short-circuited to the second common node CS_N during the charge reuse period. Taking the scan line SL3 as an example, the data lines DL1, DL3, DL7 DL9 outputting the positive-polarity data voltages are short-circuited to the first common node CS_P during the charge reuse period, in other aspect, and in other aspect, the data voltages of multiple pixels coupled to the scan line SL3 and located in the pixel columns C1, C4, C8, and C9 are short-circuited to the first common node CS_P during the charge reuse period. In addition, the data lines DL4, DL6, DL10, DL12 outputting the negative-polarity data voltages are short-circuited to the second common node CS_N, and in other aspect, the data voltages of multiple pixels coupled to the scan line SL3 and located in the pixel columns C5, C6, C10, and C13 are short-circuited to the second common node CS_N.

Figure 13:
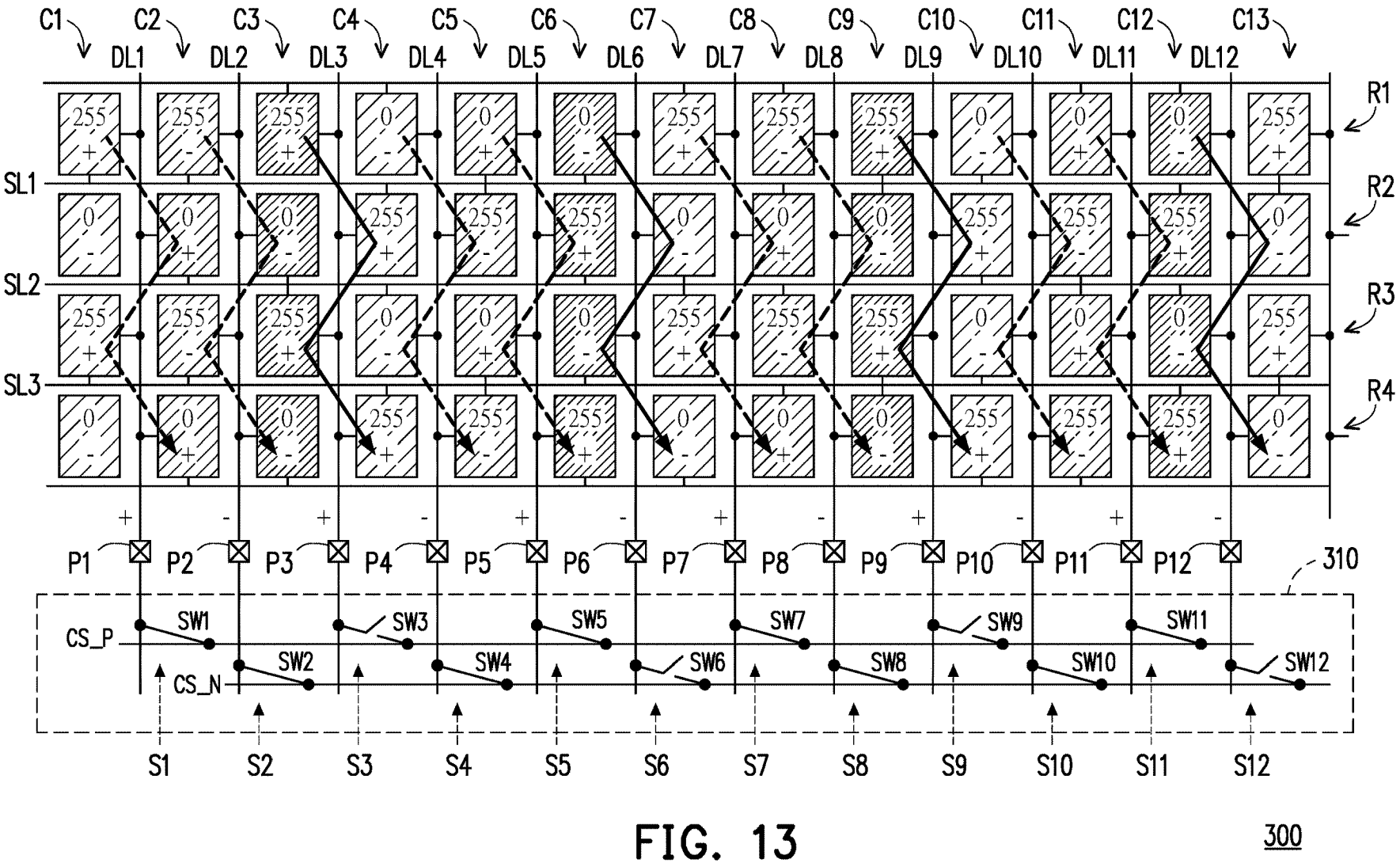
FIG. 13 is a schematic diagram of displaying "Checker pattern" on the display panel of the second embodiment.

FIG. 13 is a schematic diagram of displaying "Checker pattern" on the display panel of the second embodiment. Please see FIG. 13. As the scan line period advances, the grayscale values corresponding to the data voltages output by the data lines DL1, DL2, DL4, DL5, DL7, DL8, DL10, and DL11 are as shown by the dotted arrows and transit between the maximum grayscale value 255 and the minimum grayscale value 0. As the scan line period advances, the data voltages output by the data lines DL3, DL6, DL9, and DL12 will not change as shown by the solid arrows. Therefore, the switch control circuit (not shown) controls the switches SW1, SW2, SW4, SW5, SW7, SW8, SW10, and SW11 to be turned on in the charge reuse period, so as to activate the charge recovery mechanism. At the same time, the switch control circuit controls the switches SW3, SW6, SW9, and SW12 to be turned off (the charge recovery mechanism does not need to be activated because the data voltages do not change). It is important to note that for the first common node CS_P or for the second common node CS_N, when the charge recovery mechanism is activated, there are two data lines outputting the same-polarity data voltages corresponding to the grayscale value 255 and two data lines outputting the same-polarity data voltages corresponding to the grayscale value 0 being short-circuited together to a respective common node (i.e. the first common node CS_P or the second common node CS_N) during the charge reuse period, to obtain the initial data voltage with the grayscale value 128. Therefore, the optimal power saving effect may be achieved.

Specifically, taking the scan line SL1 as an example, the pixels coupled to the scan line SL1 and located in the pixel columns C1, C5, C8, and C12 are short-circuited to the first common node CS_P during the charge reuse period. In addition, the pixels coupled to the scan line SL1 and located in the pixel columns C2, C5, C9, and C10 are short-circuited to the second common node CS_N during the charge reuse period. Taking the scan line SL2 as an example, the pixels coupled to the scan line SL2 and located in the pixel columns C2, C6, C7, and C11 are short-circuited to the first common node CS_P during the charge reuse period. In addition, the pixels coupled to the scan line SL2 and located in the pixel columns C3, C4, C8, and C11 are short-circuited to the second common node CS_N during the charge reuse period. Taking the scan line SL3 as an example, the pixels coupled to the scan line SL3 and located in the pixel columns C1, C5, C8, and C12 are short-circuited to the first common node CS_P during the charge reuse period. In addition, the coupled to the scan line SL3 and located in the pixel columns C2, C5, C9, and C10 are short-circuited to the second common node CS_N during the charge reuse period.

Figure 14:
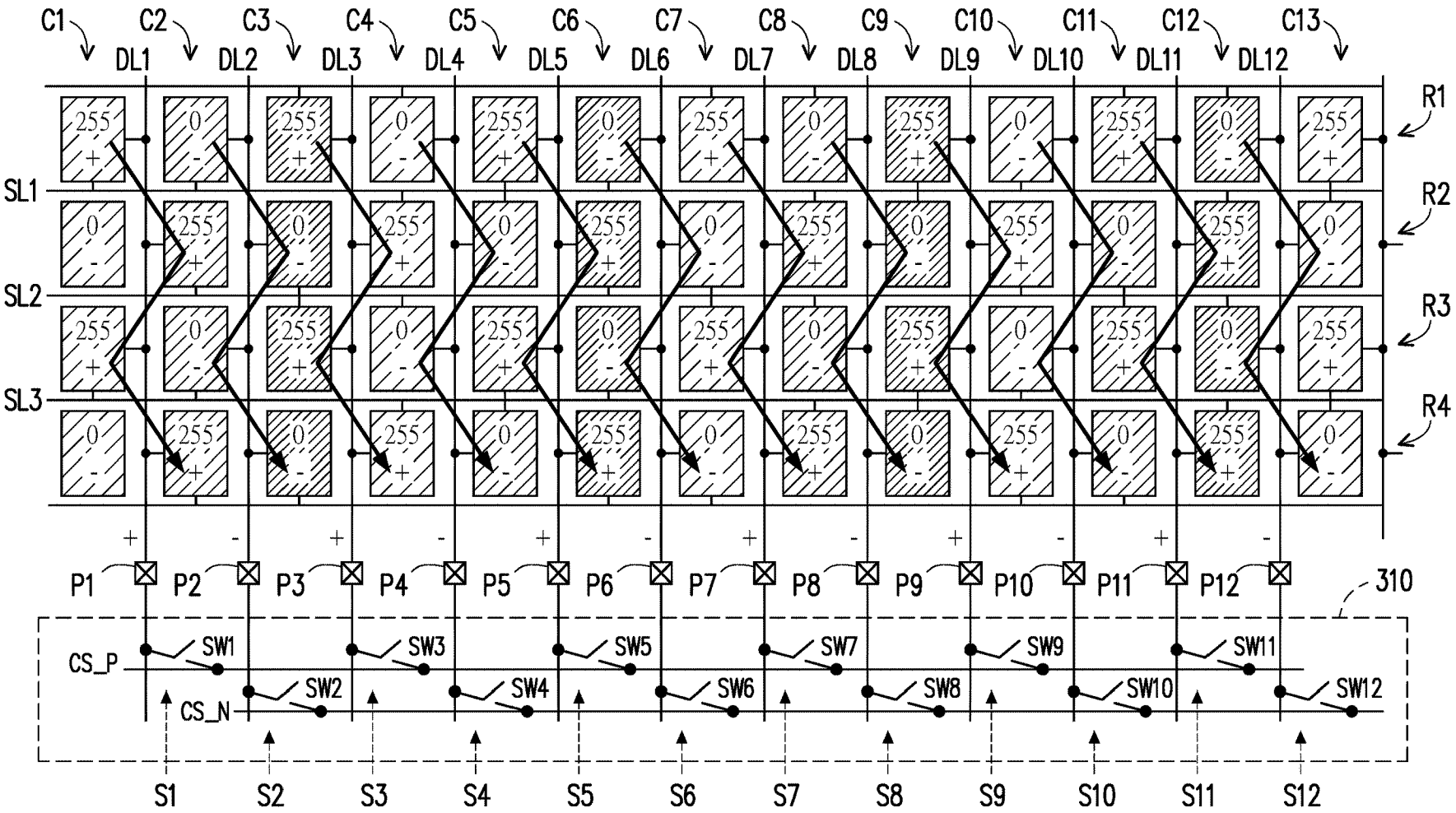
FIG. 14 is a schematic diagram of displaying "Sub Checker pattern" on the display panel of the second embodiment.

FIG. 14 is a schematic diagram of displaying "Sub Checker pattern" on the display panel of the second embodiment. As shown in FIG. 14, as the scan line period advances, the data voltages output by the data lines DL1 to DL12 do not change as shown by the solid arrows. Since the data voltages do not change, there is no need to activate the charge recovery mechanism. Therefore, the switch control circuit (not shown) controls the switches SW1 to SW12 to be turned off in the charge reuse period.

Figure 15:
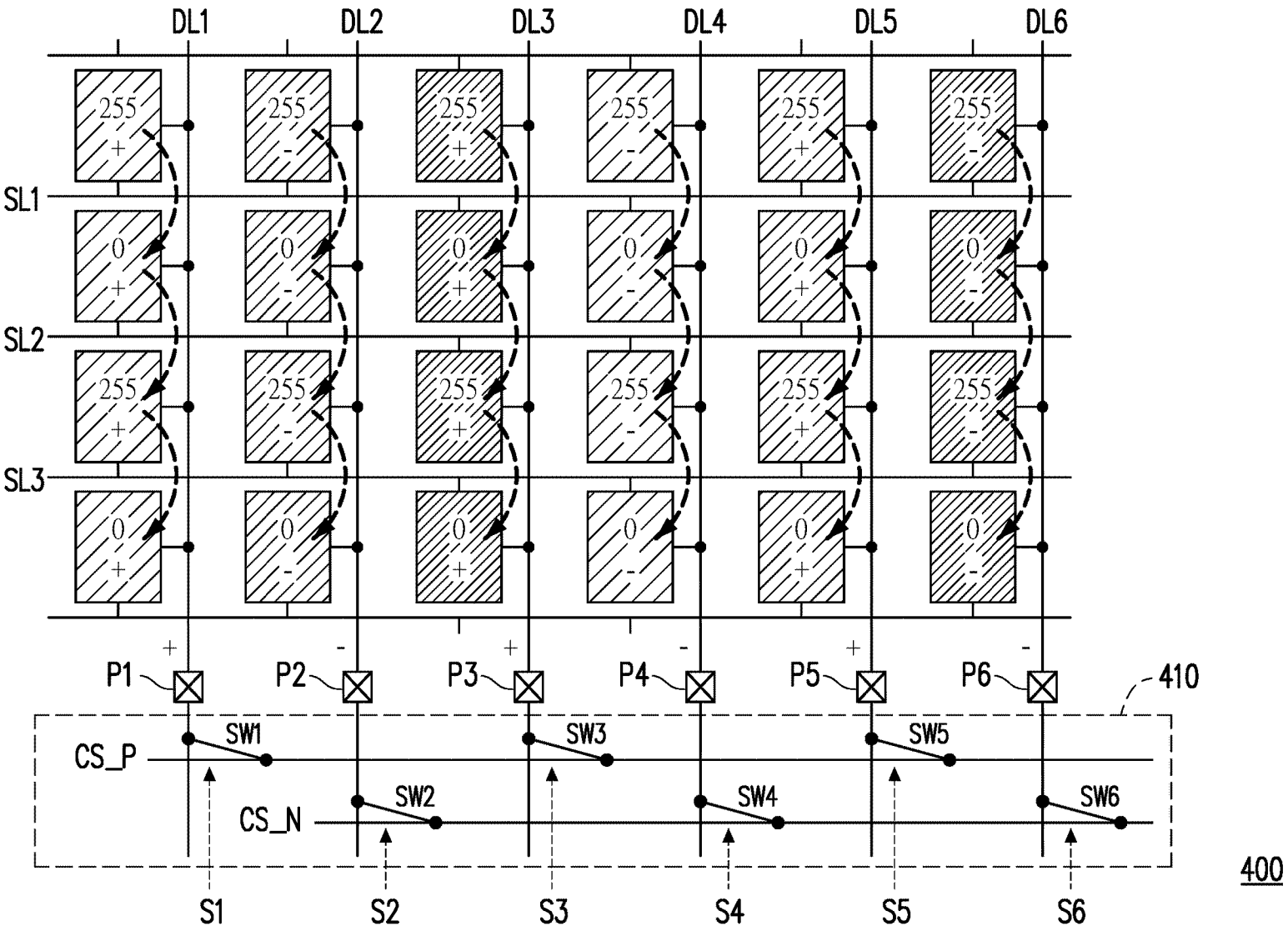
FIG. 15 is a schematic diagram of a pixel array of a display panel according to a third embodiment of the disclosure.

FIG. 15 is a schematic diagram of a pixel array of a display panel according to a third embodiment of the disclosure. The only difference between the third embodiment shown in FIG. 15 and the first embodiment shown in FIG. 2 is that the charge recovery mechanism of the third embodiment is based on a group of 6 data channels (data lines DL1 to DL6) instead of a group of 12 data channels. When a display panel 400 of the third embodiment is used to display "H line", as the scan line period advances, the grayscale values corresponding to the data voltages output via the multiple data lines DL1 to DL6 are as shown by the dotted arrows and transit between the grayscale value 255 and the grayscale value 0. Based on the operation method shown in FIG. 4, the switch control circuit (not shown) controls the multiple switches SW1 to SW6 of a switch group 410 to be turned on in the charge reuse period, so as to activate the charge recovery mechanism. However, for the first common node CS_P, when the charge recovery mechanism is activated, there are two data lines outputting the positive-polarity data voltages corresponding to the grayscale value 255 and one data line outputting the positive-polarity data voltage corresponding to the grayscale value 0 being short-circuited together, or there are one data line outputting the positive-polarity data voltage corresponding to the grayscale value 255 and two data line outputting the positive-polarity data voltages corresponding to the grayscale value 0 being short-circuited together. In other words, the number of grayscale values 255 and grayscale values 0 are not equal. Under such situation, the initial data voltage is corresponding to grayscale value 85 or 170. The same situation applies to the second common node CS_N. It should be noted that obtaining the initial data voltage corresponding to the grayscale value 85 or 170 may still bring about a power saving effect, but the effect is not as good as the initial data voltage corresponding to the grayscale value 128.

When the display panel 400 of the third embodiment is used to display "R pattern", as the scan line period advances, the data voltages output via the multiple data lines DL1 to DL6 do not change. Since charge recovery is not required, the switches SW1 to SW6 are controlled to be turned off in the charge reuse period. When the display panel 400 of the third embodiment is used to display "Checker pattern", as the scan line period advances, the grayscale values corresponding to the data voltages output via the multiple data lines DL1 to DL6 transit between the grayscale value 255 and the grayscale value 0. Since charge recovery is required, the switches SW1 to SW6 are controlled to be turned on in the charge reuse period, so as to obtain the initial data voltage corresponding to the grayscale value 85 or 170. Similarly, when the display panel 400 of the third embodiment is used to display "Sub Checker pattern", the grayscale values corresponding to the data voltages output by the multiple data lines DL1 to DL6 transit between the grayscale value 255 and the grayscale 0 as the scan line period advances. Therefore, the switches SW1 to SW6 are controlled to be turned on in the charge reuse period, so as to obtain the initial data voltage corresponding to the grayscale value 85 or 170. It can be seen that when the display panel 400 of the third embodiment is used to display "Checker Pattern" and "Sub Checker Pattern", there are cases where the number of grayscale values 255 and grayscale values 0 are not equal. Therefore, the power saving effect is not as good as the initial data voltage corresponding to the grayscale value 128.

Figure 16:
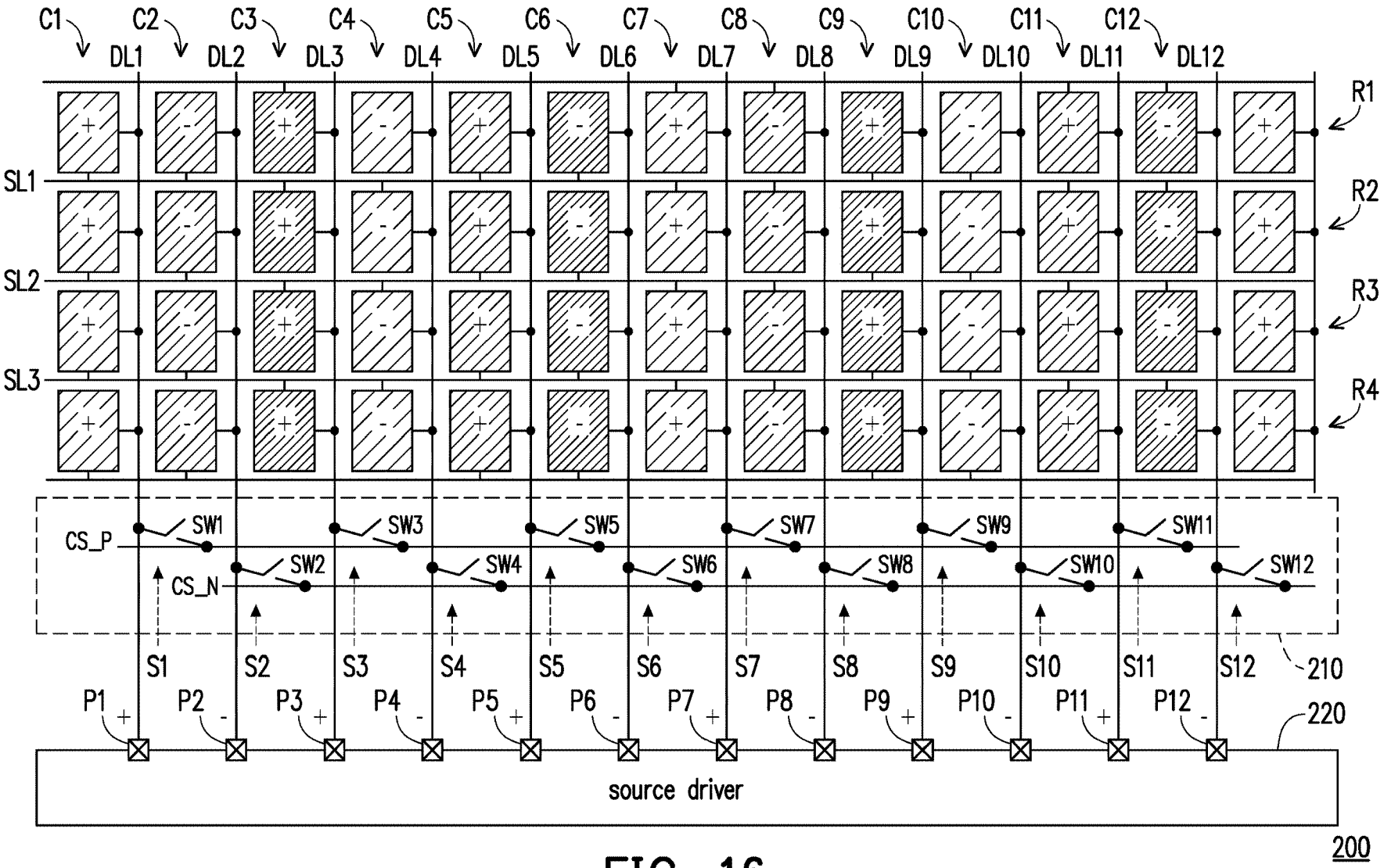
FIG. 16 is a schematic diagram of a switch control circuit disposed on the display panel.

It should be noted that although the charge recovery mechanism of the above three embodiments is based on a group of 12 data channels or 6 data channels, the disclosure is not limited thereto. In other embodiments, the charge recovery mechanism may be a group of other number of data channels (for example, 24). In the above three embodiments, the switch group 210 may be disposed in the source driving circuit and coupled to the data lines DL1 to DL12 through multiple nodes P1 to P12 (for example, pads of a driving integrated circuit). For example, the above switch control circuit may be disposed in the source driving circuit and implemented by a logic circuit, but the disclosure is not limited thereto. In another embodiment, the above switch control circuit may be disposed in a timing controller and implemented by a logic circuit. In another embodiment, the switch group 210 may be disposed on a display panel (for example, a panel adopting low temperature poly-silicon (LTPS) technology for manufacturing the TFT substrate) instead of in the source driving circuit or the timing controller. FIG. 16 is a schematic diagram of a switch control circuit disposed on the display panel. The only difference between FIG. 16 and FIG. 2 is that the switch group 210 is disposed on the display panel 200 instead of in the source driving circuit 220.

In summary, the relevant functions of the switch control circuit may be implemented as hardware using hardware description languages (HDL) (for example, Verilog HDL or VHDL) or other suitable programming languages. Also, the switch control circuit may be implemented in one or more controllers, microcontrollers, microprocessors, application-specific integrated circuits (ASICs), digital signal processors (DSP), field programmable gate arrays (FPGAs), and/or various logic blocks, modules, and circuits in other processing units.

In summary, the disclosure may change the coupling relationship between multiple pixels, multiple data lines, and multiple scan lines of the display panel, so that the data voltages output from the source driver during each scan line period may drive pixels distributed in two adjacent display lines (pixel rows) and thereby a charge recharge recovery mechanism may be operated in an efficient way even in displaying some specified pattern. The action of the switch group may be combined to reduce the power consumption of the display panel through the charge recovery mechanism, and the usage efficiency is more preferable.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display panel, comprising:

a pixel array, arranged in a plurality of pixel rows by a plurality of pixel columns, comprising a first pixel row, a second pixel row, and a third pixel row which are adjacent pixel rows;

a plurality of data lines;

a first scan line, coupled to a plurality of first pixel groups, wherein each of the first pixel groups comprises a plurality of first pixels in the first pixel row and a plurality of second pixels in the second pixel row adjacent to the first pixel row;

a second scan line, adjacent to the first scan line and coupled to a plurality of second pixel groups, wherein each of the second pixel groups comprises a plurality of second pixels in the second pixel row and a plurality of third pixels in the third pixel row adjacent to the second pixel row, wherein the plurality of second pixels in each of the first pixel group and the plurality of second pixels in each of the second pixel groups are different pixels;

a plurality of switches, comprising a plurality of first switches and a plurality of second switches; and a first common node and a second common node, wherein each of the first switches is coupled between the first common node and a corresponding first data line among a plurality of first data lines among the data lines, and each of the second switches is coupled between the second common node and a corresponding second data line among a plurality of second data lines among the data lines, wherein, during a charge reuse period after at least one of the first pixel groups has displayed and before at least one of the second pixel groups displays, pixel electrodes of pixels driven by positive-polarity data voltages in the at least one of the first pixel groups are short-circuited and pixel electrodes of pixels driven by the negative-polarity data voltages in the at least one of the first pixel groups are short-circuited, wherein whether each of the first switches and the second switches is turned on depends on a difference value between first grayscale information corresponding to a data voltage to be transmitted by a corresponding data line among the data lines during a first scan line period and second grayscale information corresponding to a data voltage transmitted by the same data line during a second scan line period, wherein the second scan line period immediately follows the first scan line period.

2. The display panel according to claim 1, wherein each of the data lines is coupled to pixels of a respective pixel column among the pixel columns, and every pixel of each of the first pixel groups is coupled to a respective data line among the data lines.

3. The display panel according to claim 1, wherein each of the data lines is coupled to pixels of two adjacent pixel columns among the pixel columns, and one of the pixels in the first pixel row and one of the pixels in the second pixel row are disposed in a different pixel column.

4. The display panel according to claim 1, wherein each of the first pixel groups and the second pixel groups is configured to be as a charge reuse group, and in each charge reuse group, the number of pixels driven by the positive-polarity data voltages equals to the number of pixels driven by the negative-polarity data voltages.

5. The display panel according to claim 1, wherein the first data lines are coupled to pixels driven by first-polarity data voltages, wherein the second data lines are coupled to pixels driven by second-polarity data voltages, wherein a first-polarity is one of a positive-polarity and a negative-polarity, and a second-polarity is the other one of the positive-polarity and the negative-polarity.

6. The display panel according to claim 5, wherein during the charge reuse period after the at least one of the first pixel groups has displayed and before the at least one of the second pixel groups displays, the switches are respectively configured to be in a turn-on state or a turn-off state, such that charges stored in the pixels driven by the first-polarity data voltages of the first pixel group are averaged and charges stored in the pixels driven by the second-polarity data voltages of the first pixel group are averaged.

7. A display driving circuit for driving a display panel, wherein the display panel comprises a pixel array arranged in a plurality of pixel rows by a plurality of pixel columns, a plurality of data lines, and a plurality of scan lines, each of the scan lines is coupled to a plurality of pixel groups, wherein each of the pixel groups comprises pixels distributed in two adjacent pixel rows, the display driving circuit comprising:

a plurality of first output nodes and a plurality of second output nodes, wherein the first output nodes are respectively configured to couple to a plurality of first data lines among the data lines of the display panel and the second output nodes are respectively configured to couple to a plurality of second data lines among the data lines of the display panel;

a switch control circuit, configured to generate a plurality of control signals, wherein during a charge reuse period after at least one of the pixel groups coupled to a first scan line has displayed and before at least one of the pixel groups coupled to a second scan line adjacent to the first scan line displays, at least part of the first output nodes are short-circuited to a first common node and at least part of the second output nodes are short-circuited to a second common node different from the first common node according to the control signals; and a plurality of switches respectively coupled to the output nodes and comprising a plurality of first switches and a plurality of second switches, wherein each of the first switches is coupled between the first common node and a corresponding first output node among the first output nodes, and each of the second switches is coupled between the second common node and a corresponding second output node among the second output nodes, wherein the first output nodes are configured to output first-polarity data voltages, the second output nodes are configured to output second-polarity data voltages, a first-polarity is one of a positive-polarity and a negative-polarity, and a second-polarity is the other one of the positive-polarity and the negative-polarity.

8. The display driving circuit according to claim 7, wherein the control signals are configured to respectively control each of the switches to be in a turn-on state or a turn-off state, such that the at least part of the first output nodes are short-circuited to the first common node through at least part of the first switches in a turn-on state and the at least part of the second output nodes are short-circuited to the second common node through at least part of the second switches in a turn-on state.

9. The display driving circuit according to claim 8, wherein the control signals are configured to turn on or turn off each of the first switches and the second switches according to a difference value between first grayscale information corresponding to a data voltage to be transmitted by a corresponding data line during a first scan line period and second grayscale information corresponding to a data voltage to be transmitted by the same data line during a second scan line period, wherein the second scan line period immediately follows the first scan line period.

10. The display driving circuit according to claim 9, wherein whether each of the first switches and the second switches is turned on is determined through comparing the difference value and a threshold.

11. The display driving circuit according to claim 7, wherein the display panel further comprises a plurality of switches, comprising a plurality of first switches and a plurality of second switches, wherein each of the first switches is coupled between the first common node and a corresponding first data line among the first data lines, each of the second switches is coupled between the second common node and a corresponding second data line among the second data lines.

12. The display driving circuit according to claim 7, wherein the control signals are configured to turn on or turn off each of the first switches and the second switches according to a difference value between first grayscale information corresponding to a data voltage to be transmitted by a corresponding data line during a first scan line period and second grayscale information corresponding to a data voltage to be transmitted by the same data line during a second scan line period, wherein the second scan line period immediately follows the first scan line period.

13. The display driving circuit according to claim 12, wherein whether each of the first switches and the second switches is turned on is determined through comparing the difference value and a threshold.

* * * * *